US011427944B2

(12) United States Patent
Goto et al.

(10) Patent No.: US 11,427,944 B2
(45) Date of Patent: Aug. 30, 2022

(54) SEWING DEVICE

(71) Applicant: MATSUYA R&D CO., LTD., Ono (JP)

(72) Inventors: Hidetaka Goto, Fukui (JP); Tatsuo Sako, Ono (JP); Masahi Nakano, Osaka (JP)

(73) Assignee: MATSUYA R&D CO., LTD., Ono (JP)

( * ) Notice: Subject to any disclaimer, the term of this patent is extended or adjusted under 35 U.S.C. 154(b) by 135 days.

(21) Appl. No.: 17/049,517

(22) PCT Filed: Sep. 18, 2019

(86) PCT No.: PCT/JP2019/036487
§ 371 (c)(1),
(2) Date: Oct. 21, 2020

(87) PCT Pub. No.: WO2020/059733
PCT Pub. Date: Mar. 26, 2020

(65) Prior Publication Data

US 2021/0079574 A1 Mar. 18, 2021

(30) Foreign Application Priority Data

Sep. 20, 2018 (JP) ..... JP2018-175777
Feb. 19, 2019 (JP) ..... JP2019-027546
(Continued)

(51) Int. Cl.
*D05B 25/00* (2006.01)
*D05B 19/12* (2006.01)
*D05B 39/00* (2006.01)

(52) U.S. Cl.
CPC ..... *D05B 25/00* (2013.01); *D05B 19/12* (2013.01); *D05B 39/00* (2013.01)

(58) Field of Classification Search
CPC ..... D05B 25/00; D05B 19/12; D05B 19/14; D05B 19/16; D05B 39/00; D05B 39/005;
(Continued)

(56) References Cited

U.S. PATENT DOCUMENTS 5,875,726 A * 3/1999 Keilmann ..... B25J 9/0084 112/475.08
6,129,031 A * 10/2000 Sarh ..... D05B 25/00 901/41
(Continued)

FOREIGN PATENT DOCUMENTS

CN 101003292 A 7/2007
CN 204434920 U 7/2015
(Continued)

OTHER PUBLICATIONS

Chang Chi-long et al., "Apparel Practical Design" (Shanghai Culture Publishing Co., 19940228), First Print Feb. 1994, vol. 3000 ISBN7 80511-640-7/TS.102, p. 148.

*Primary Examiner* — Ismael Izaguirre
(74) *Attorney, Agent, or Firm* — R. Neil Sudol; Henry D. Coleman

(57) ABSTRACT

A straight guide rail extending in an X direction is provided in a sewing platform portion for installing in a fixed state a pallet holding an object to be sewn, and first and second sewing machines are provided at left and right sides of the straight guide rail as viewed in the X direction. The first and second sewing machines are both provided with a movement support platform which allow the straight guide rail to reciprocate in the X direction, and the movement support platform is provided with a sewing machine body which is capable of reciprocating in a Y direction. The first and second sewing machines are program controlled in such a manner that any one thereof is capable of moving from one side of the straight guide rail toward the other side beyond
(Continued)

a middle section thereof during the sewing operation of the first and second sewing machines.

20 Claims, 22 Drawing Sheets

(30) Foreign Application Priority Data

May 7, 2019 (JP) ..... JP2019-087334
Sep. 12, 2019 (JP) ..... JP2019-166135

(58) Field of Classification Search
CPC ..... D05B 69/00; D05B 69/20; D05B 69/04; D05B 69/22; D05B 69/28; D05B 69/36; D05B 75/00; D05B 83/00
See application file for complete search history.

(56) References Cited

U.S. PATENT DOCUMENTS

| | | | | |
|---|---|---|---|---|
| 2003/0140832 | A1* | 7/2003 | Ton | D05C 5/02 112/475.01 |
| 2008/0003083 | A1 | 1/2008 | Solomon | |
| 2017/0049517 | A1* | 2/2017 | Felder | A61B 34/10 |

FOREIGN PATENT DOCUMENTS

| | | | |
|---|---|---|---|
| CN | 107618708 | A | 1/2018 |
| CN | 206939612 | U | 1/2018 |
| CN | 108085876 | A | 5/2018 |
| EP | 2089849 | A * | 6/1982 |
| EP | 0220368 | A2 | 5/1987 |
| EP | 2392526 | A1 | 12/2011 |
| JP | H0426448 | A | 1/1992 |
| JP | 05-095478 | U | 12/1993 |
| JP | 2007153480 | A | 6/2007 |
| JP | 2018153535 | A | 10/2018 |
| KR | 20180082147 | A | 7/2018 |
| WO | WO 2008065964 | A1 | 6/2008 |

* cited by examiner

SEWING DEVICE

TECHNICAL FIELD

The present invention relates to a sewing device which can be installed while achieving a space saving when sewing an object to be sewn entirely being long by arranging a long object to be sewn such as a long curtain airbag for constructing a curtain airbag device installed in a vehicle interior of a motor vehicle, and a lot of short object pieces to be sewn in a straight line, and can contribute to an increase in productivity and a reduction of production cost.

BACKGROUND ART

A curtain airbag constructing a curtain airbag device installed in a vehicle interior of a motor vehicle is an example of a long object to be sewn and is installed long in a front-back direction along a side door glass in the vehicle interior. An example thereof is described in Patent Literature 1. The curtain airbag is structured, for example, as shown in FIG. 22A, such that attachment pieces c to a vehicle are attached to an edge portion b of an airbag body a constructed as a long object at required intervals, and base parts d of the attachment pieces c are fixed to the edge portion b by sewing. Further, the airbag body a has a length, for example, about 2 m, is provided with a plurality of chambers, and can be inflated to a deployed state by a high-pressure gas ejected from an inflator being fed to each of the chambers via a gas inflow port e.

One example of a conventional sewing work for sewing the base part d of the attachment piece c to the edge portion b of the airbag body a having the structure mentioned above was achieved, for example, by using nine sewing machines which were provided in correspondence to nine attachment pieces c (FIG. 22A) fixed to the edge portion b. These nine sewing machines were arranged in an internal corner portion g side of an L-shaped wall f, for example, as shown in FIG. 23. First to fourth sewing machines h1, h2, h3 and h4 were provided in parallel in a fixed state in one side j of the internal corner portion g of the L-shaped wall f, and fifth to ninth sewing machines h5, h6, h7, h8 and h9 were provided in parallel in a fixed state in the other side k of the internal corner portion g of the L-shaped wall f.

Further, the corresponding sewing machine sequentially sews a base part d of a corresponding attachment piece c to the edge portion b, for example, the first sewing machine h1 sews a base part d (FIG. 22B) of a first attachment piece c1 fixed to one end side of the airbag body a to the edge portion b according to a required sewing pattern, and the second sewing machine h2 sews a base part d of a second attachment piece c2 leading to the first attachment piece c1 to the edge portion b according to a required sewing pattern. As described above, a worker applies the base part d of the required attachment piece c to the sewing part of the sewing machine and sews all the attachment pieces c to the edge portion b.

This sewing is normally achieved by two workers in cooperation. A first worker takes charge of four attachment pieces c1 to c4 in one end side, and transfers the airbag body 1 to a second worker after the end of the work, and the second worker takes charge of sewing of the remaining five attachment pieces c5 to c9, thereby sewing the base parts d of all the attachment pieces c to the edge portion b and finishing fixing of the attachment piece c to the airbag body 1. However, such a human-intensive sewing work has a poor production efficiency, and each of the workers has one sewing machine associated with the sewing of the base part d, so that the remaining sewing machines stop during the sewing of the one sewing machine. Therefore, there is a problem that a production cost of the airbag is increased due to poor operation efficiency of an entire sewing machine.

Consequently, a sewing method using a sewing device m1 shown in FIG. 24 was performed. The sewing device m1 was structured such that one sewing machine p was fixed to a fixed position of a sewing platform, and a pallet q holding the airbag body 1 was laterally movable on the sewing platform n. Further, a base part d (FIG. 22B) of each of a required number of attachment pieces c was sequentially sewn to the edge portion b along with the lateral movement of the pallet q, the attachment pieces c in which the base parts d are temporarily attached to the edge portion b of the airbag body a. According to the sewing method, one sewing machine p can sew the base parts d of all the attachment pieces c to the edge portion b of the airbag body a, and all the attachment pieces c can be sequentially sewn by automatically moving the pallet 1 laterally. Therefore, there is an advantage that an increase in productivity can be more expected in comparison with the sewing method mentioned above.

FIG. 25 shows a sewing device m2 which is developed for responding to a demand for further increasing a productivity. In the sewing device m2, an entire length of a sewing platform n for installing the pallet q having the same structure as mentioned above was set to be twice the entire length of the sewing platform n shown in FIG. 24. Further, two sewing machines, first and second sewing machines r1 and r2 were arranged in the sewing platform n in a fixed state at fixed positions at a required interval, and two pallets, a first pallet q1 and a second pallet q2 were provided on the sewing platform n such that they can laterally move on a straight line.

A sewing method using the sewing device m2 comprised, for example, as shown in FIG. 25, the steps of sewing by the first sewing machine r1 the base part d of the attachment piece c fixed to an approximate right half shown in FIG. 22A in the airbag body a held to the first pallet q1 to the edge portion b, thereafter moving the first pallet q1 to the second sewing machine r2 side, and sewing by the second sewing machine r2 the base part d of the attachment piece c fixed to the remaining approximate left half to the edge portion b. Further, the first sewing machine r1 performs the sewing operation in the approximate right half of the airbag body a held to a new pallet 1 while the second sewing machine r2 performs a sewing operation in the approximate left half. More specifically, the first sewing machine r1 and the second sewing machine r2 sew different airbag bodies a, however, the sewing operation for the airbag body 1 held to the first pallet q1 and the sewing operation for the airbag body a held to the second pallet q2 can be simultaneously performed.

When sewing by using the sewing device m2 as mentioned above, the base part d of each of all the attachment pieces c for the edge portion b of the airbag body a can be sewn during the lateral movement of the pallet q from an end to an end in the sewing platform n. As a result, the productivity can be enhanced about twice in comparison with the sewing method in which the pallet q can laterally move in relation to one sewing machine fixed to the fixed position.

However, according to the sewing device m1 in which the pallet q is laterally moved on the sewing platform n where one sewing machine p is installed, a space having about twice length (about 4 m) the length (about 2 m) of the airbag body a is required for installing the sewing device, and there is a problem that a long installation space is required.

Further, according to the sewing device m2 in which first and second sewing machines r1 and r2 are installed, a significantly wide installation space having about twice length (about 8 m) is required in comparison with the sewing device in which one sewing machine is installed. Since the installation space of the sewing device is enlarged as mentioned above, a cost increase of an in-plant space per unit area is caused, so that an increase of an equipment cost is caused. Therefore, there is a problem that a production cost per one airbag is increased.

Next, a sewing device disclosed by Patent Literature 2 is described as the other conventional example of the sewing device sewing the long object to be sewn. The sewing device according to Patent Literature 2 is structured such that sewing machines are provided respectively in two straight guide rails which are individually arranged in parallel in both sides on a base plate, and both the sewing machines can linearly move respectively in a direction of an X-axis. However, the respective sewing machines can only sew in previously determined separate working areas, both the sewing machines can not sew the same working area, and both the sewing machines can not assist the sewing operation of the other end sewing machine in the same working area.

CITATION LIST

Patent Literature

Patent Literature 1: WO2008/065964

Patent Literature 2: Japanese Patent Unexamined Publication No. 4-26448

SUMMARY OF INVENTION

Technical Problem

An object of the present invention is to provide a sewing device which can achieve a space saving for installation when performing a required sewing for a sewn product, and can expect an increase in productivity and a reduction of production cost.

Solution to Problem

In order to solve the problem mentioned above, the present invention employs the following means.

More specifically, in a first aspect of a sewing device according to the present invention, a straight guide rail extending in an X direction is provided in a sewing platform portion for installing in a fixed state a pallet holding an object to be sewn, and one first sewing machine or a plurality of first sewing machines disposed in parallel, and one second sewing machine or a plurality of second sewing machines disposed in parallel are provided at left and right sides of the straight guide rail as viewed in the X direction. The first sewing machine and the second sewing machine are both provided with a movement support platform which allow the straight guide rail to reciprocate in the X direction, and the movement support platform is provided with a sewing machine body which is capable of reciprocating in a Y direction. The first sewing machine and the second sewing machine are both capable of sewing in the same sewing area extending in the X direction, and the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines. Further, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

In a second aspect of a sewing device according to the present invention, a straight guide rail extending in an X direction is provided in a sewing platform portion for installing in a fixed state a pallet holding an object to be sewn, one first sewing machine or a plurality of first sewing machines disposed in parallel, and one second sewing machine or a plurality of second sewing machines disposed in parallel are provided at left and right sides of the straight guide rail as viewed in the X direction, the first sewing machine and the second sewing machine are both provided with a movement support platform which allow the straight guide rail to reciprocate in the X direction, and the movement support platform is provided with a sewing machine body which is capable of reciprocating in a Y direction. The first sewing machine and the second sewing machine are both capable of sewing in the same sewing area extending in the X direction, the first sewing machine and the second sewing machine are both capable of forward moving toward an object to be sewn which is held by the pallet, and the forward moving directions of both the sewing machine are the same. Further, the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines. Further, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

In a third aspect of a sewing device according to the present invention, a straight guide rail extending in an X direction is provided in a sewing platform portion for installing in a fixed state a pallet holding an object to be sewn, one first sewing machine or a plurality of first sewing machines disposed in parallel, and one second sewing machine or a plurality of second sewing machines disposed in parallel are provided at left and right sides of the same straight guide rail as viewed in the X direction, the first sewing machine and the second sewing machine are both provided with a movement support platform which allow the straight guide rail to reciprocate in the X direction, and the movement support platform is provided with a sewing machine body which is capable of reciprocating in a Y direction. The first sewing machine and the second sewing machine are both capable of sewing in the same sewing area extending in the X direction, the first sewing machine and the second sewing machine are both capable of forward moving toward an object to be sewn which is held by the pallet, and the forward moving directions of both the sewing machine are the same. Further, the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

In a fourth aspect of a sewing device according to the present invention, a straight guide rail extending in an X direction is provided in a sewing platform portion for installing in a fixed state a pallet holding an object to be sewn, one first sewing machine or a plurality of first sewing machines disposed in parallel, and one second sewing machine or a plurality of second sewing machines disposed in parallel are provided at left and right sides of the same straight guide rail as viewed in the X direction, the straight guide rail is constituted by a first straight guide rail and a second straight guide rail which are separately provided, the first straight guide rail is provided with the first sewing machine, the second straight guide rail is provided with the second sewing machine, the first sewing machine and the second sewing machine are both provided with a movement support platform which allow the straight guide rail to reciprocate in the X direction, and the movement support platform is provided with a sewing machine body which is capable of reciprocating in a Y direction. The first sewing machine and the second sewing machine are both capable of sewing in the same sewing area extending in the X direction, the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines. Further, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

A fifth aspect of a sewing device according to the present invention is the sewing device according to any one of the first to fourth aspects, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range. Further, when the first sewing machine is troubled during the sewing operation of the first and second sewing machines, the first sewing machine can be moved to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range.

A sixth aspect of a sewing device according to the present invention is the sewing device according to any one of the first to fourth aspects, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range. Further, when the first sewing machine is troubled during the sewing operation of the first and second sewing machines, the first sewing machine can be moved to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range. Further, the first and second sewing machine can be both moved to any one of the first evacuation rail part and the second evacuation rail part.

A seventh aspect of a sewing device according to the present invention is the sewing device according to any one of the first to fourth aspects, wherein the sewing device is provided with a horizontally circulating movement path for moving the pallet in a required order in such a manner as to draw a rectangular shape in a planar view, the horizontally circulating movement path is provided with a front side part extending in a lateral direction and a rear side part extending in the lateral direction at a required interval, a left portion of the front side part is formed as a first work station, a right portion of the front side part is formed as a second work station, a right portion of the rear side part is formed as a third work station, a left portion of the rear side part is formed as a fourth work station, and the pallet is adapted to temporarily stop in the first work station, the second work station, the third work station and the fourth work station. Further, a sewing operation is adapted to be performed by the first and second sewing machine to the object to be sewn which the pallet in the first work station holds, a new object to be sewn is adapted to be held to the pallet in the third work station and the fourth work station during the sewing operation, the pallet moves to the second work station to come to a temporary stop state when the sewing operation to the object to be sewn held in the pallet is finished in the first work station, a sewing finished product is removed from the pallet in the second work station, the pallet thereafter moves to the third work station to a temporary stop state, and thereafter moves to the fourth work station to a temporary stop state, the object to be sewn is held to the pallet in the third work station and the fourth work station, the pallet holding the object to be sewn moves to the first work station, and the sewing operation is applied to the object to be sewn as mentioned above.

An eighth aspect of a sewing device according to the present invention is the sewing device according to any one of the first to fourth aspects, wherein the movement support platform capable of reciprocating along the straight guide rail in the X direction is provided with an upper transverse member cutting across the pallet in a front-back direction above the pallet, and a lower transverse member arranged below the upper transverse member and cutting across the pallet in the front-back direction. The lower transverse member is substantially integrated with the upper transverse member, and the upper transverse member is provided with an upper accommodation part in such a manner that the upper accommodation part is capable of reciprocating in the Y direction, the upper accommodation part constructing the sewing machine body and in which a needle bar drive mechanism moving a sewing machine needle up and down is accommodated. Further, the lower transverse member is provided with a lower accommodation part in such a manner that the lower accommodation part is capable of reciprocating in the Y direction, the lower accommodation part constructing the sewing machine body and in which a shuttle feeding a bobbin thread is accommodated, and the upper and lower accommodation parts are synchronously movable in the X and Y directions according to a program control. Further, leg column parts are protruded downward in both end sides of the upper transverse member, and lower end portions of both the leg column parts are capable of reciprocating in the X direction by being guided along the straight guide rail provided along front and rear edge parts of the sewing platform portion and extending in the X direction.

Effect of the Invention

The present invention employs the structure mentioned above. Therefore, the present invention can achieve a space saving for installation and expect an increase in productivity and a reduction in production cost when a required sewing operation is performed to an object to be sewn. A description will be specifically given of the same below.

(1) The present invention is different from the structure in which two sewing machines are provided in the fixed state at the required intervals and the sewing operation is performed while moving the pallet in the sewing platform portion, such as the sewing device m2 described with reference to FIG. 25. Alternatively, the present invention employs the structure in which the sewing operation is performed in a state in which the pallet is installed in the fixed state in the sewing platform portion, and the first sewing machine and the second sewing machine are reciprocated along the straight guide rail extending in the X direction.

Therefore, according to the present invention, the sewing device can be installed while reducing an installation space in a length direction of the device, and a cost per unit area of an in-plant space can be reduced by the space saving. Accordingly, an equipment cost can be reduced, and a production cost of a sewn product such as an airbag can be expected to be reduced.

(2) Further, the first and second sewing machines can both sew in the same sewing area extending in the X direction, and are program controlled in such a manner that any one thereof can move from one side of the straight guide rail toward the other side thereof beyond the middle section thereof, the safety device for collision avoidance is provided so as to prevent the first sewing machine and the second sewing machine from colliding with each other, and the sewing operation of the first sewing machine and the second sewing machine is performed by the required movement of the first and second sewing machine in the X and Y directions according to the program control. Therefore, according to the present invention, the first sewing machine and the second sewing machine can sew the same object to be sewn in a wide area, and both the sewing machines can assist the sewing operation of the other end sewing machine in the same working area each other. Accordingly, it is possible to sew with improved productivity within the working area by changing a program regardless of a shape and a magnitude of the object to be sewn and a sewing pattern.

(3) In a case of employing the structure in which the first evacuation rail part is provided in a left end of a sewing travel range of the straight guide rail along which the first and second sewing machines move in the X direction for sewing, and the second evacuation rail part is provided in a right end of the sewing travel range, the first sewing machine can be moved to the first evacuation rail part to be evacuated when the first sewing machine is troubled, and the second sewing machine can be moved to the second evacuation rail part to be evacuated when the second sewing machine is troubled. Further, the other sewing machine having no trouble can perform the sewing operation in a whole of the sewing travel range.

Therefore, according to the sewing device having the structure mentioned above, there is an advantage that a whole sewing operation can be continued by the sewing machine having no trouble without stopping an entire operation of the sewing device in a case where any one of the first and second sewing machines is troubled.

(4) In a case of structuring such that the first and second sewing machines can both move to any one of the first and second evacuation rail parts, it is possible to collectively check a trouble in the first and second sewing machines and dissolve a trouble for two sewing machines by moving both the first and second sewing machines to the evacuation rail part. For example, it is possible to inspect and clean the first and second sewing machines when starting, and regulate the sewing motion of the sewing machine, in the evacuation rail part. Further, it is possible to replace a consumable part such as a needle and repair a broken sewing machine.

(5) In a case of structuring such that the sewing device is provided with the horizontally circulating movement path for moving the pallet in the required order in such a manner as to draw the rectangular shape in the planar view, the horizontally circulating movement path is provided with the front side part extending in the lateral direction and the rear side part extending in the lateral direction at the required interval in the front-back direction, the left portion of the front side part is formed as the first work station, the right portion thereof is formed as the second work station, the right portion of the rear side part is formed as the third work station, and the left portion thereof is formed as the fourth work station, it is possible to provide a sewing device which can expect further increase in productivity.

More specifically, it is possible to perform a work for detaching the sewing finished product in the second work station and a work for holding the object to be sewn to the pallet in the third and fourth work stations in plenty of time during a sewing time by the first and second sewing machine, on the basis of the structure mentioned above. Such being the case, the sewing motion can be continuously performed by the sewing machines without wastefully stopping the sewing motion by the first and second sewing machines. Therefore, it is possible to more effectively achieve the advantage of the increase in productivity by the first and second sewing machines.

(6) In a case where the first sewing machine and the second sewing machine are respectively constructed by a plurality of sewing machines arranged in parallel in the X direction, the sewing operation can be more efficiently performed by the plurality of first and second sewing machines, for example, even in a case where the object to be sewn extending in the X direction is long and a lot of sewing positions are provided.

(7) In a case of structuring such that the movement support platform is provided with the upper transverse member cutting across the pallet in the front-back direction above the pallet, and the lower transverse member arranged below the upper transverse member and cutting across the pallet in the front-back direction, an entire space below the upper transverse member can be set to the sewing area. Therefore, there is an advantage that a wide object to be sewn extending over approximately a whole of the lower space can be sewn with no trouble. Further, since both end sides of the upper transverse member are supported by the straight guide rail via the leg column part even if the upper transverse member is long, the needle bar drive mechanism in the sewing state can be stably supported, and it is possible to perform the sewing operation by the first and second sewing machines in a stable state.

7 is a plan view describing a sewing step of attaching the attachment piece to the edge portion of the airbag body by sewing.

Figure 8:
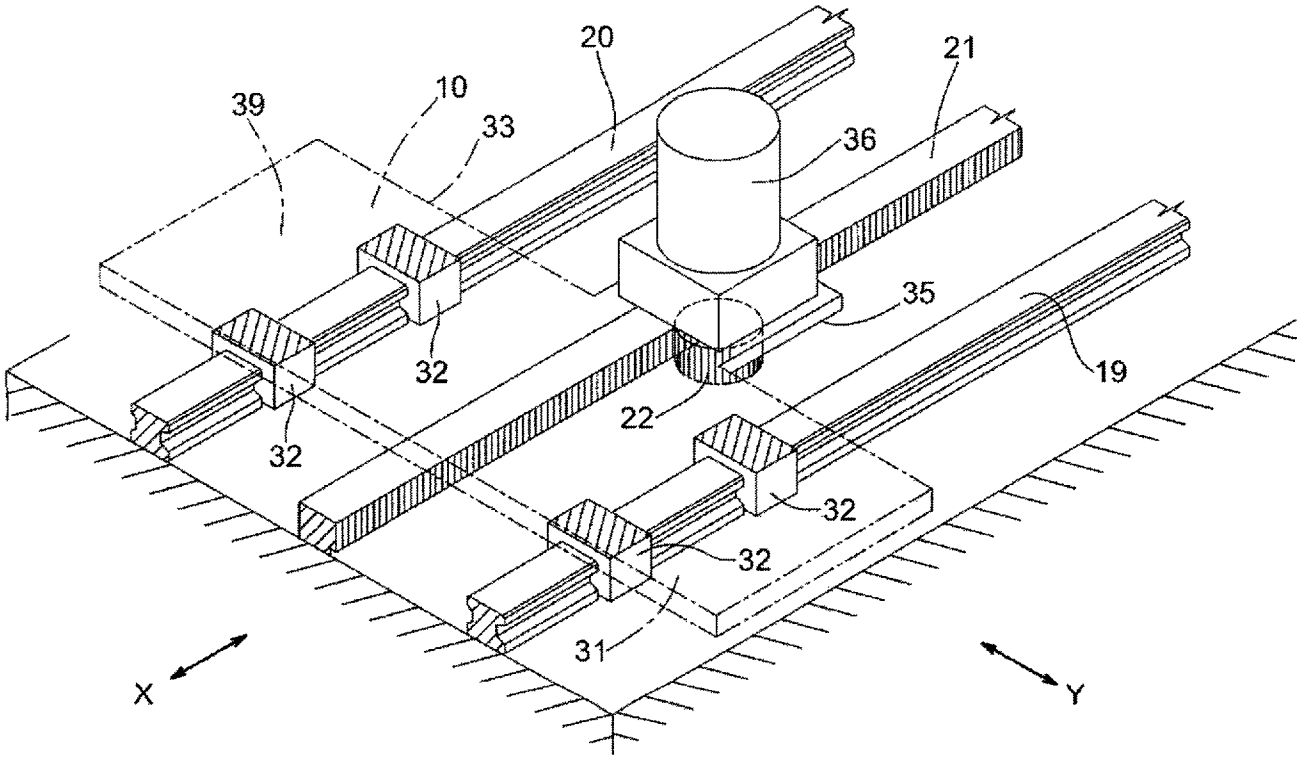

FIG. 8 is a perspective view describing a structure for reciprocating a movement support platform of the sewing device in an X direction.

Figure 9:
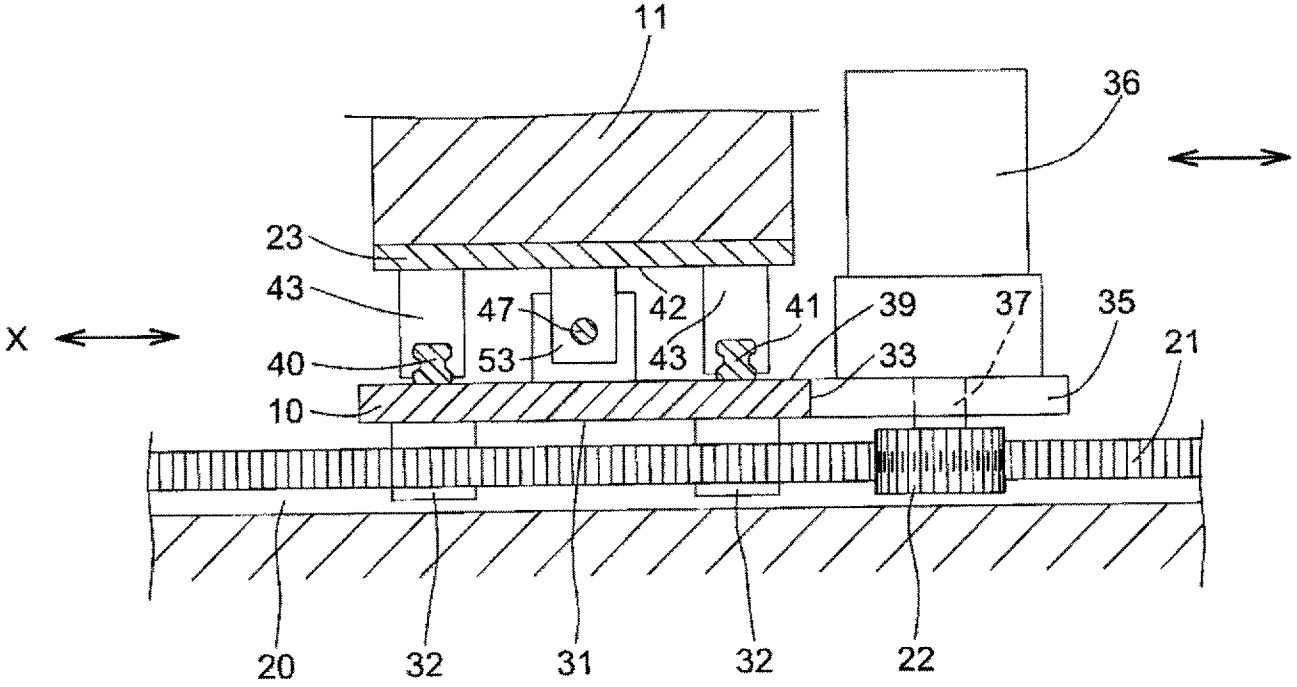

FIG. 9 is an explanatory view describing the structure for reciprocating the movement support platform of the sewing device in the X direction and a structure for reciprocating a sewing machine body in a Y direction.

Figure 10:
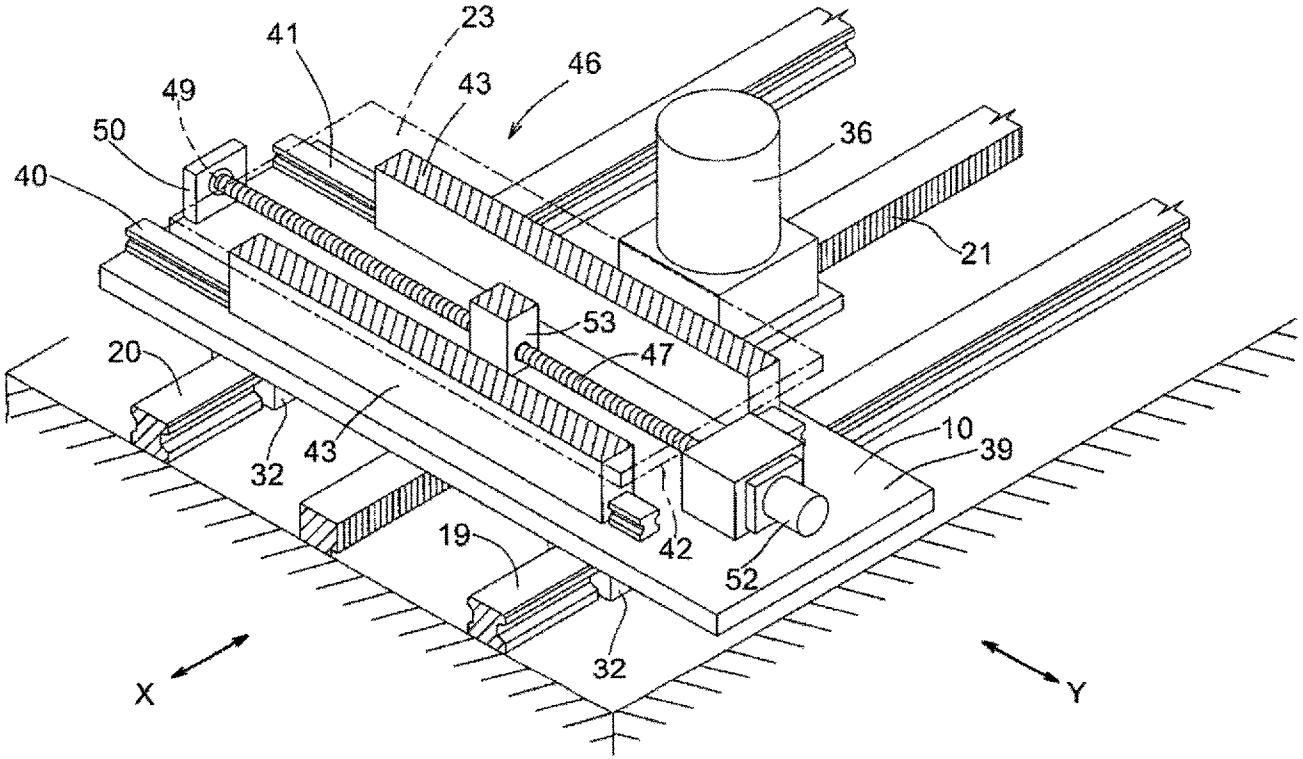

FIG. 10 is a perspective view describing the structure for reciprocating the sewing machine body in the Y direction.

Figure 11:
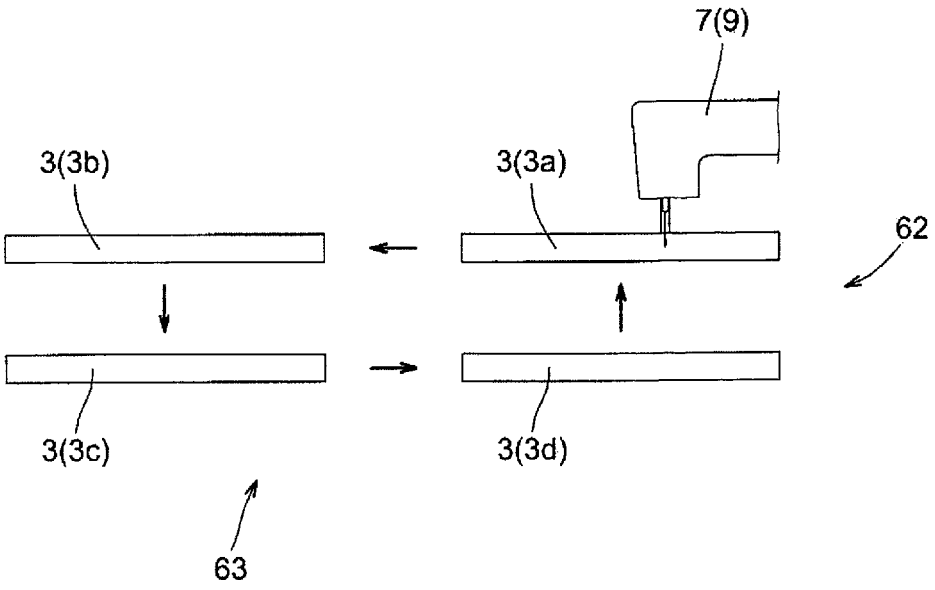

FIG. 11 is an explanatory view describing a vertically circulating movement type pallet moving device.

Figure 12A:
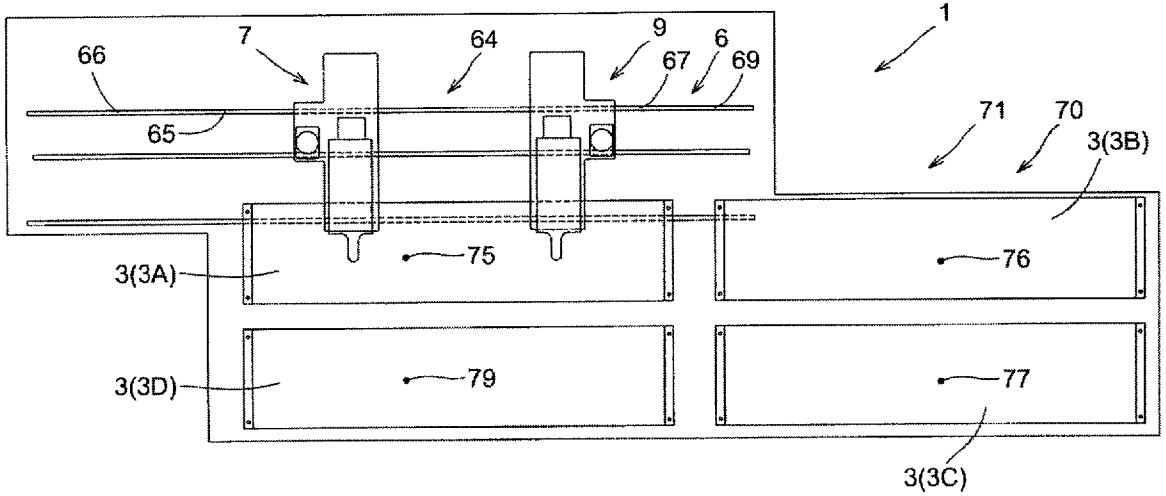
Figure 12B:
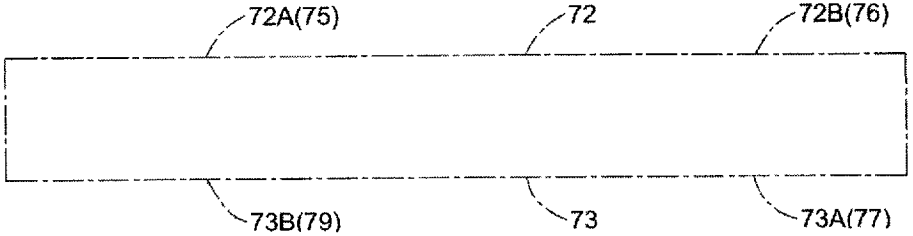

FIGS. 12A and 12B are explanatory views describing a sewing device including first and second evacuation rail parts and a horizontally circulating movement type pallet moving device.

Figure 13:
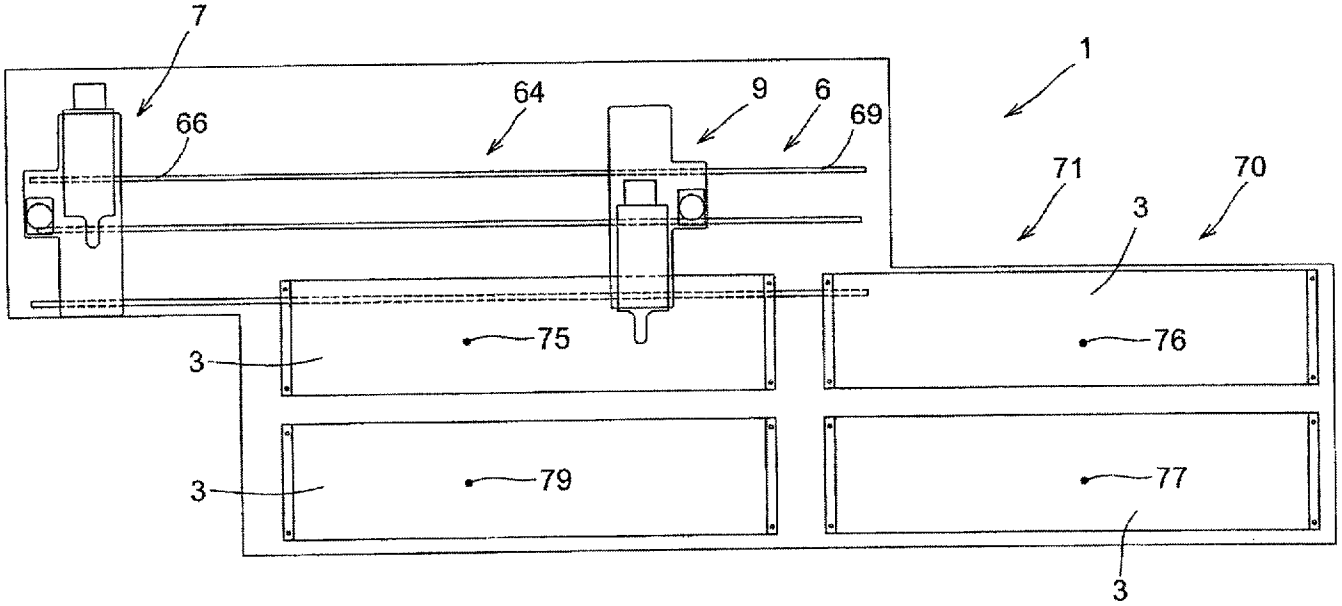

FIG. 13 is an explanatory view showing a state in which a first sewing machine is evacuated to a first evacuation rail part.

Figure 14:
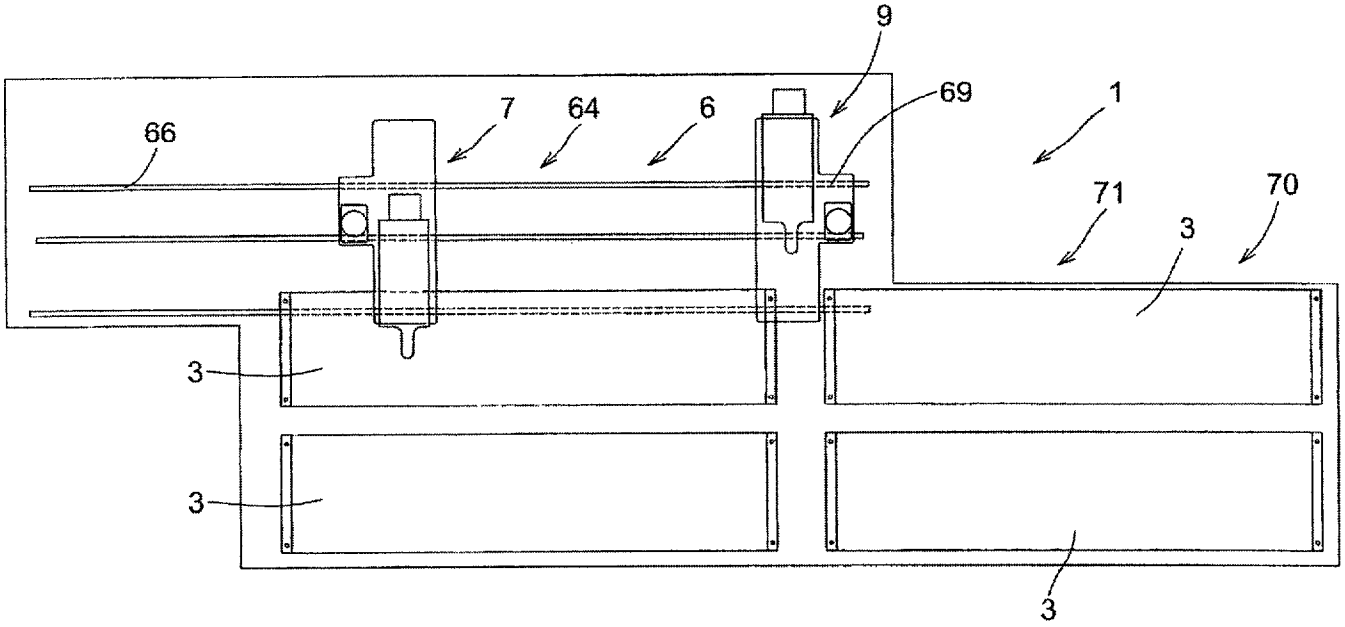

FIG. 14 is an explanatory view showing a state in which a second sewing machine is evacuated to a second evacuation rail part.

Figure 15:
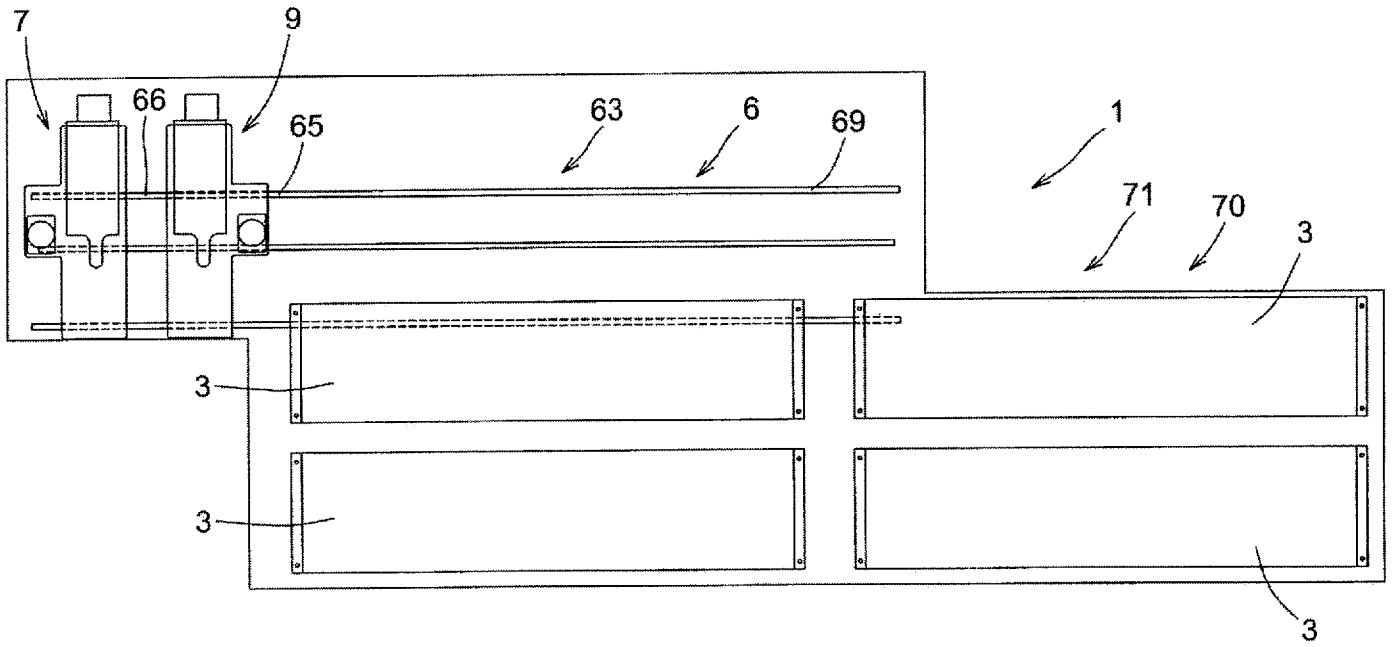

FIG. 15 is an explanatory view showing a state in which both the first and second sewing machines move to the first evacuation rail part.

Figure 16:
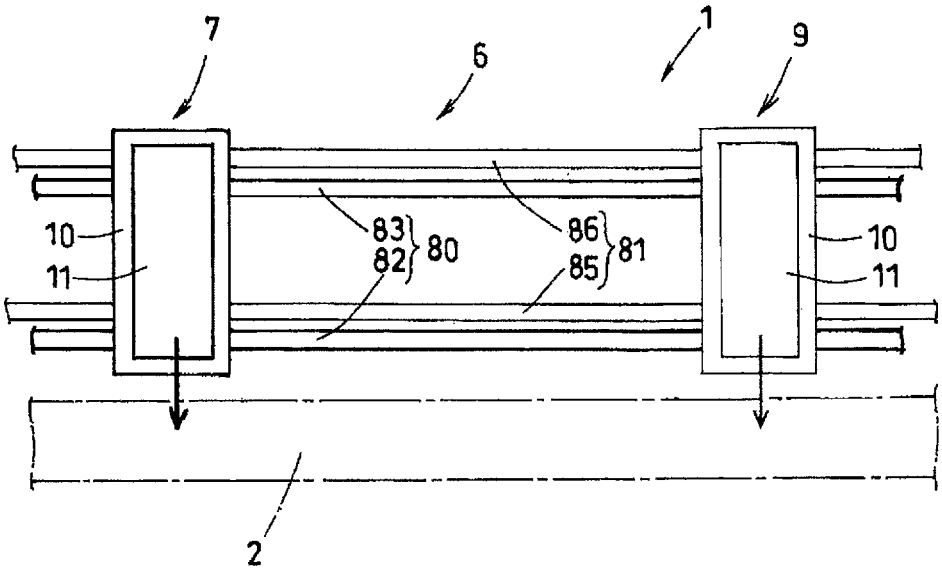

FIG. 16 is an explanatory view describing an example of a sewing device in which a straight guide rail is constructed by separately constructed first straight guide rail and second straight guide rail.

Figure 17:
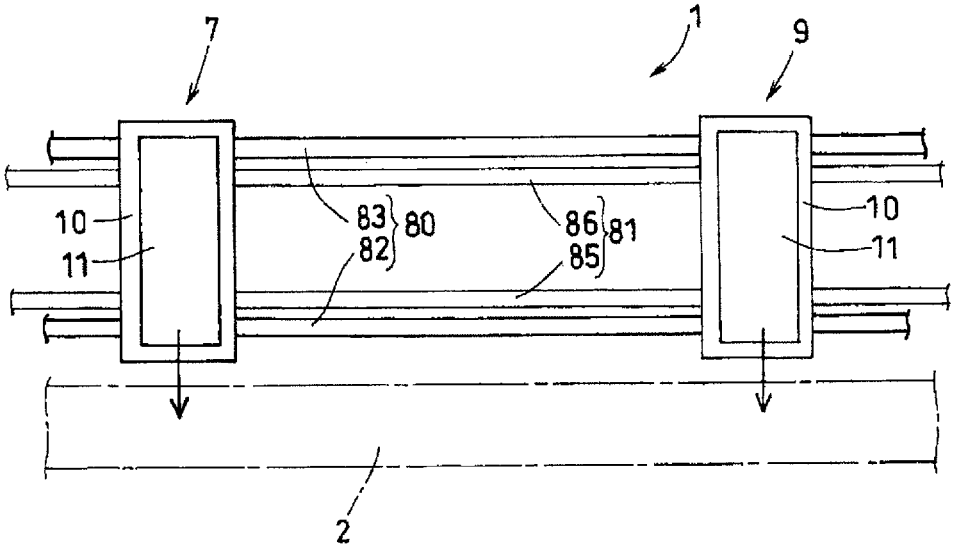

FIG. 17 is an explanatory view describing the other example of the sewing device in which the straight guide rail is constructed by the separately constructed first straight guide rail and second straight guide rail.

Figure 18:
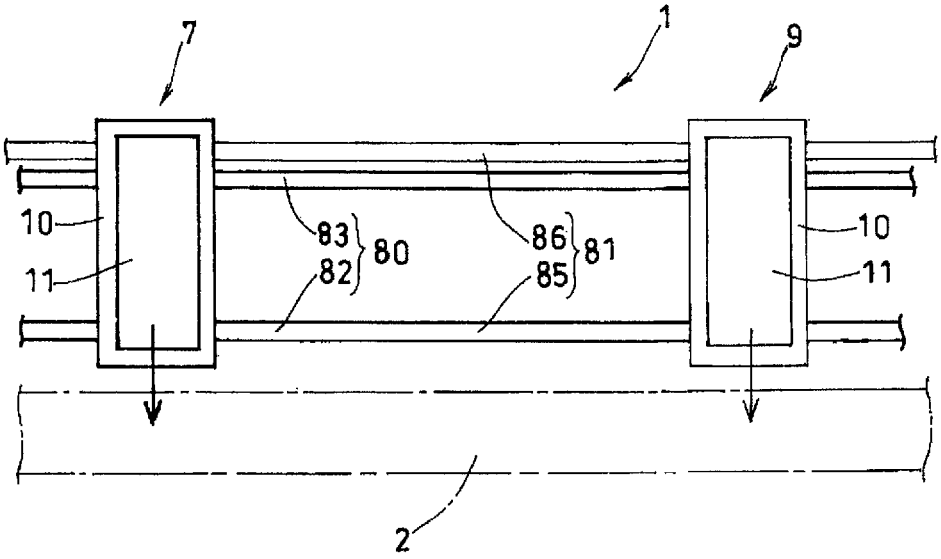

FIG. 18 is an explanatory view describing the other example of the sewing device in which the straight guide rail is constructed by the separately constructed first straight guide rail and second straight guide rail.

Figure 19:
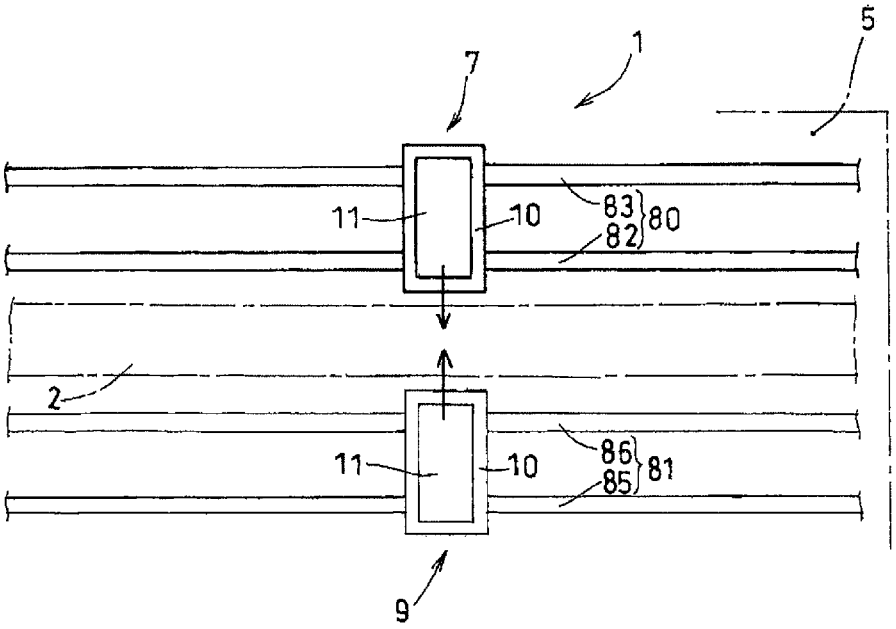

FIG. 19 is an explanatory view describing the other example of the sewing device in which the straight guide rail is constructed by the separately constructed first straight guide rail and second straight guide rail.

Figure 20:
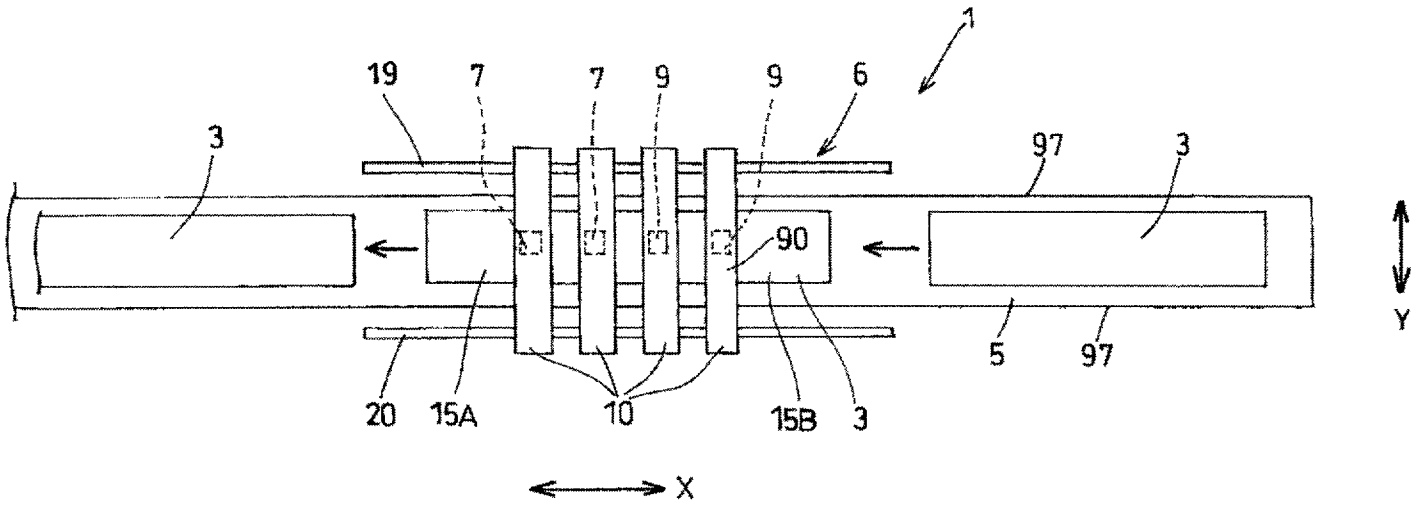

FIG. 20 is a plan view describing a sewing device including a gate-shaped movement support platform.

Figure 21:
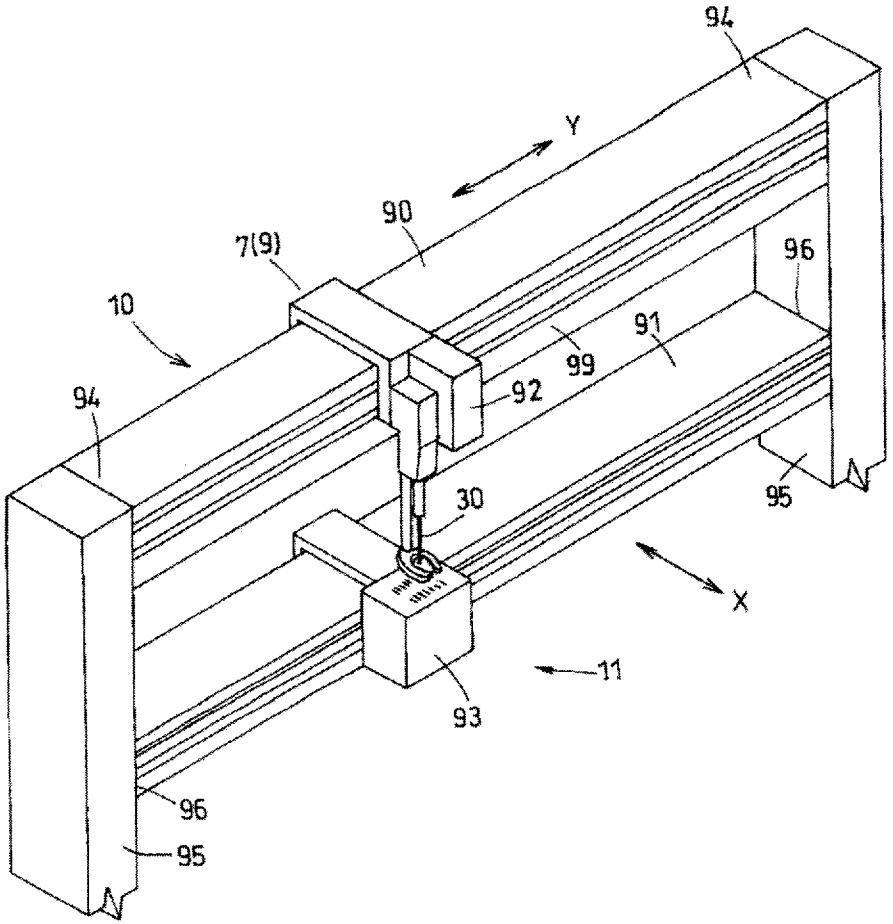

FIG. 21 is a perspective view describing the sewing device including the gate-shaped movement support platform.

Figure 22A:
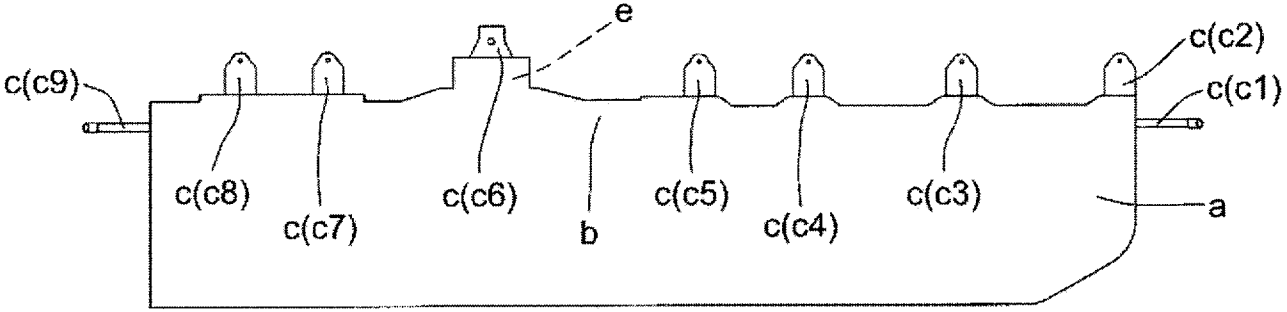
Figure 22B:
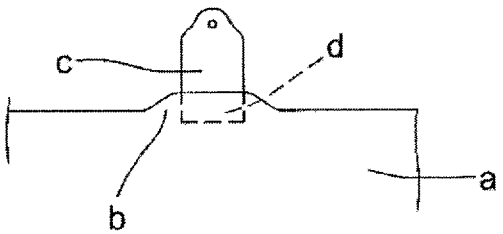

FIGS. 22A and 22B are plan views showing an example of an airbag body constructing a curtain airbag.

Figure 23:
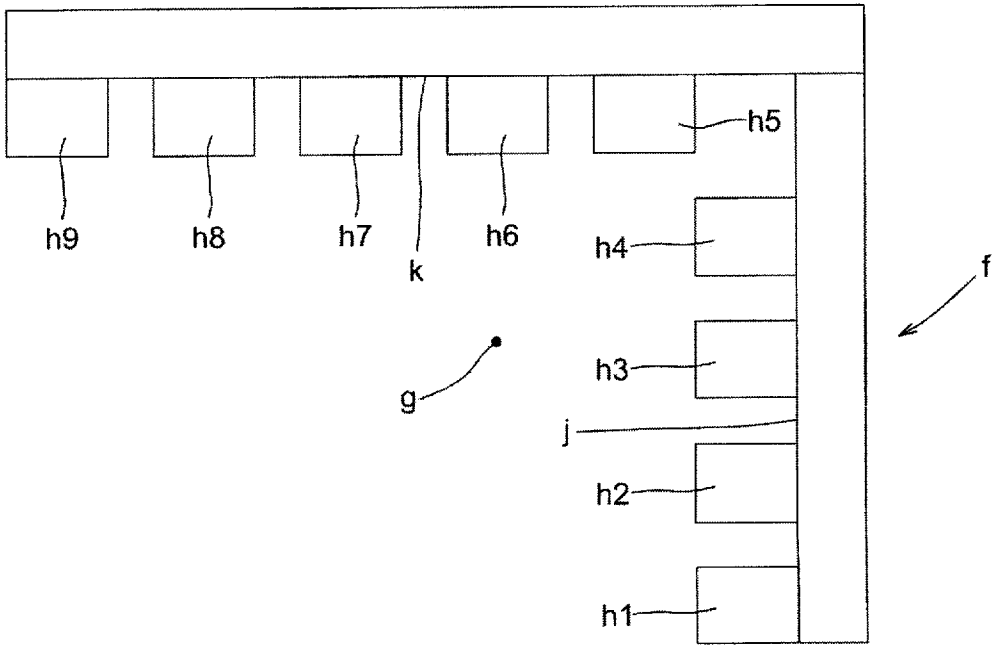

FIG. 23 is a plan view describing a conventional sewing step of attaching an attachment piece to an edge portion of an airbag body by sewing.

Figure 24:
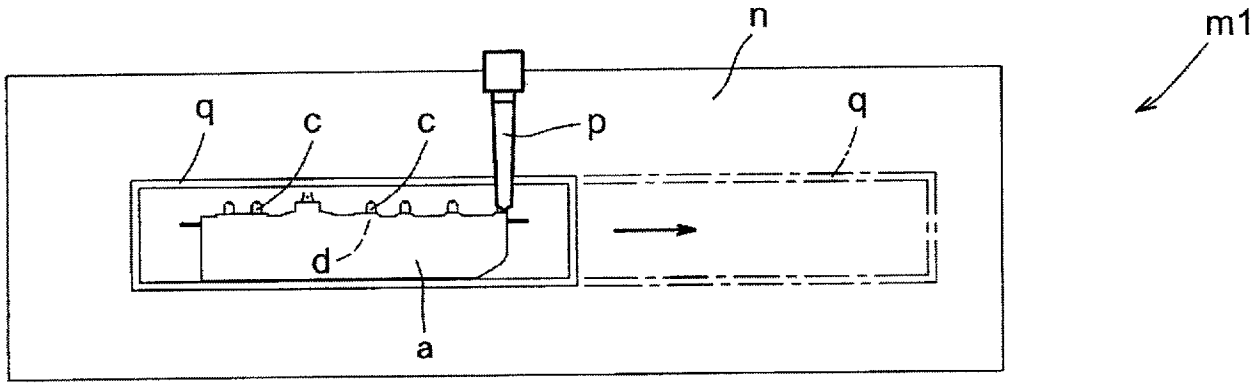

FIG. 24 is an explanatory view describing a conventional sewing device which allows a pallet to laterally move to one sewing machine fixed at a fixed position.

Figure 25:
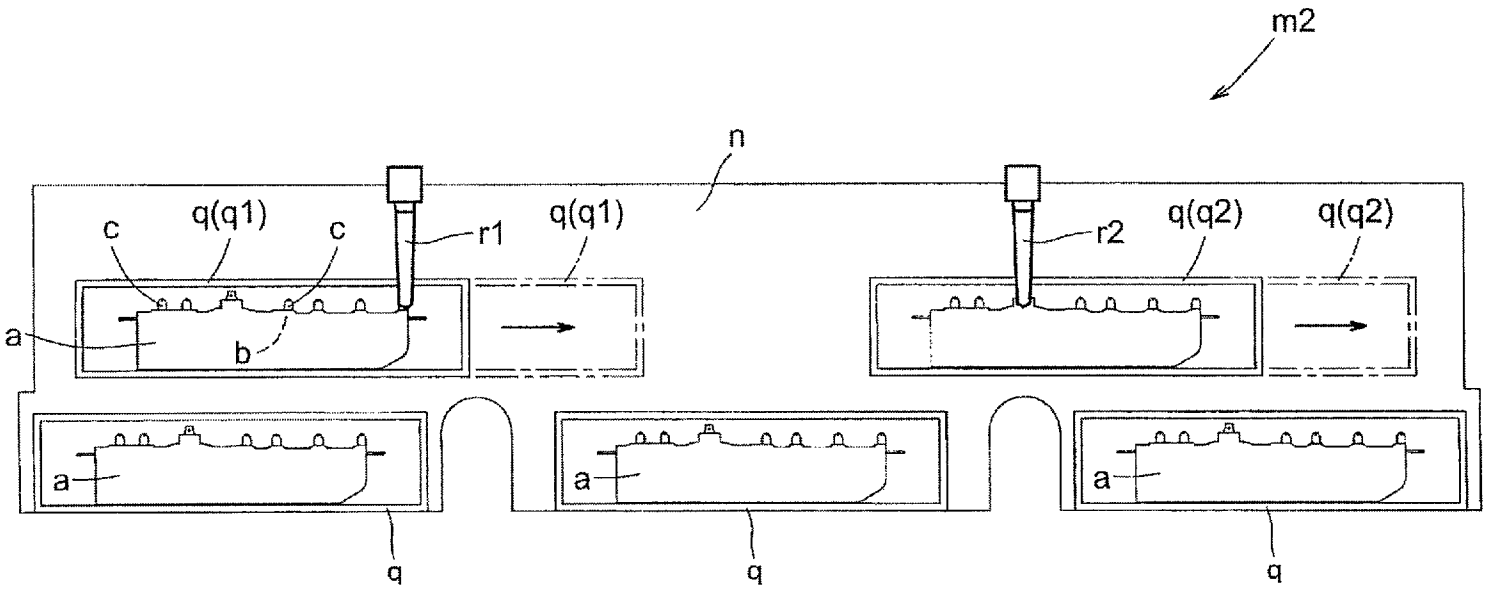

FIG. 25 is an explanatory view describing a conventional sewing device which allows a pallet to laterally move to two sewing machines fixed at fixed positions.

DESCRIPTION OF EMBODIMENTS

Embodiment 1

In FIGS. 1 to 4, in a sewing device 1 according to the present invention, a straight guide rail 6 extending in an X direction is provided in a sewing platform portion 5 for installing a pallet 3 holding an object to be sewn 2 in a fixed state, and one first sewing machine 7 and one second sewing machine 9 are provided at left and right sides of the straight guide rail 6 as viewed in the X direction.

The first sewing machine 7 and the second sewing machine 9 are both provided with a movement support platform 10 which allows the straight guide rail 6 to reciprocate in the X direction, and the movement support platform 10 is provided with a sewing machine body 11 which can reciprocate in a Y direction. In the present embodiment, the first sewing machine 7 and the second sewing machine 9 are both provided in the same straight guide rail 6, and the first and second sewing machines 7 and 9 can both sew in the same sewing area extending in the X direction. Further, the first sewing machine 7 and the second sewing machine 9 can reciprocate along the straight guide rail 6 in the X direction as long as they do not collide with each other. Further, the first and second sewing machines 7 and 9 are program controlled in such a manner that any one of the first and second sewing machines 7 and 9 can move from one side of the straight guide rail 6 toward the other side thereof beyond a middle section thereof as shown by arrows F1 and F2 in FIG. 2, during the sewing operation of the first and second sewing machines 7 and 9, and a safety device for collision avoidance is provided so as to prevent the first sewing machine 7 and the second sewing machine 9 from colliding with each other. Further, the sewing operation by the first sewing machine 7 and the second sewing machine 9 is adapted to be performed by required movement of the first and second sewing machines 7 and 9 in the X and Y directions on the basis of the program control.

Figure 1:
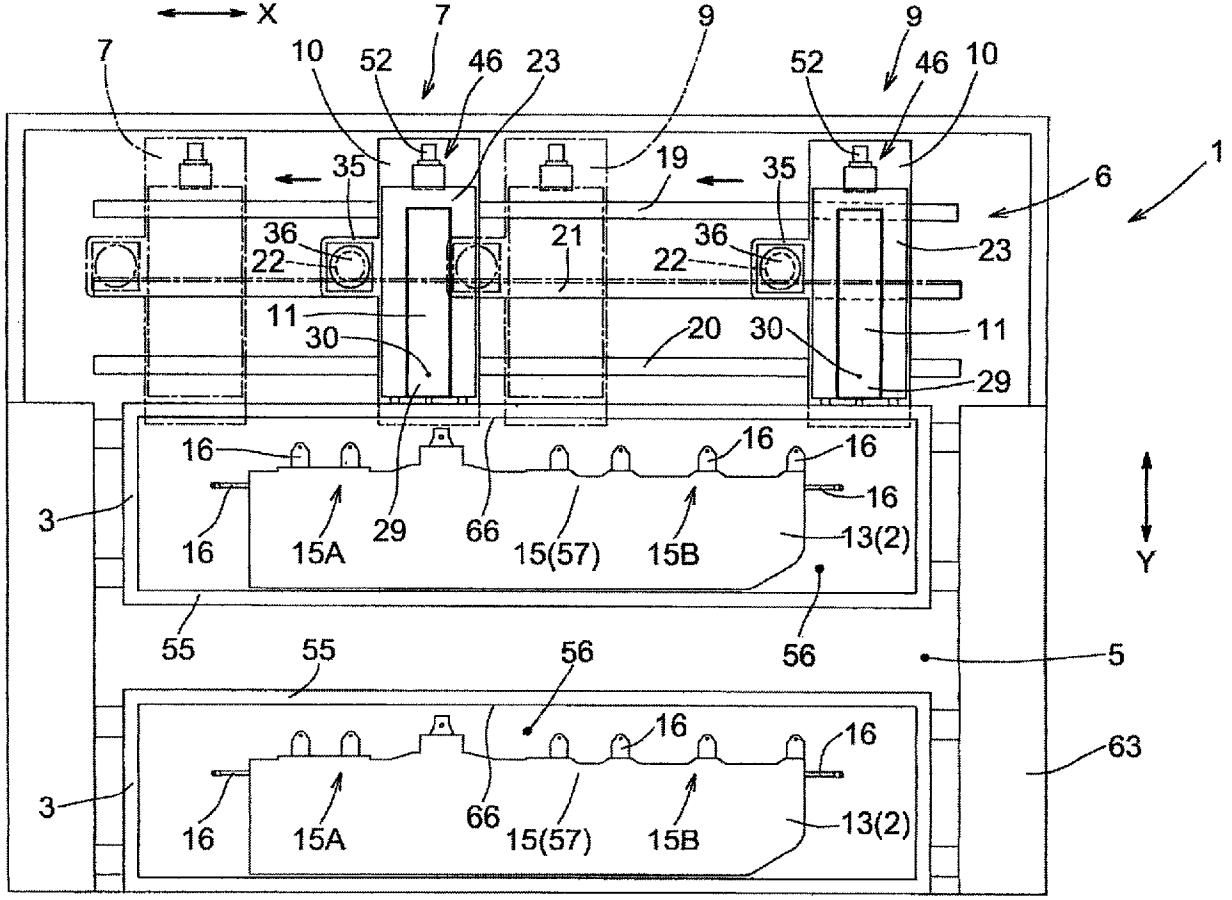
FIG. 1 is a plan view showing a sewing device according to the present invention in a state in which a sewing operation is stopped.
Figure 2:
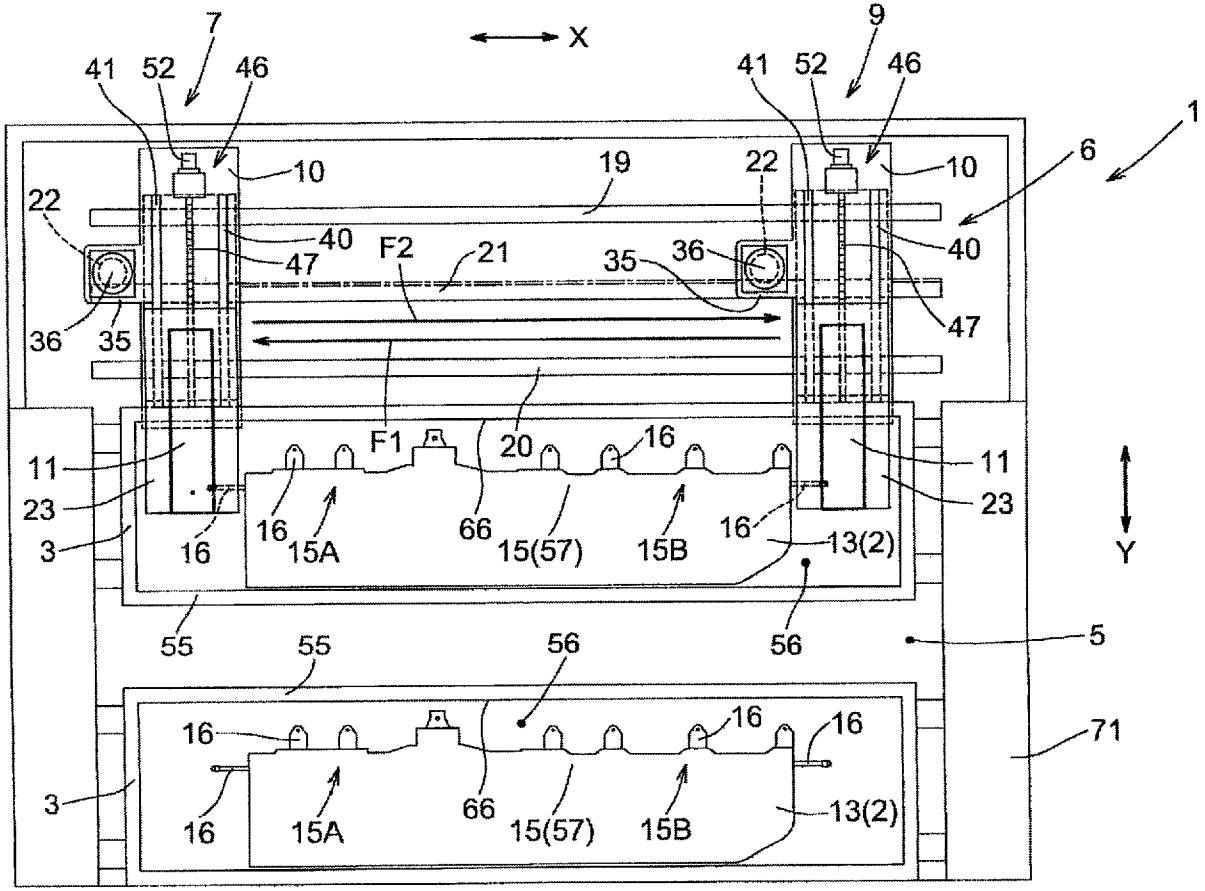
FIG. 2 is a plan view showing the sewing device according to the present invention in a state in which the sewing operation is performed.

The sewing device 1 is applied for sewing a base part 17 (FIGS. 6 to 7) of an attachment piece 16 to an edge portion 15, when the attachment pieces 16 to a vehicle are attached at required intervals to the edge portion 15 extended from an airbag body 13 (the object to be sewn 2), for example, constructing a curtain airbag, as shown in FIGS. 1 to 2 in the present embodiment. A description will be specifically given of this structure below.

The straight guide rail 6 is constructed by a first guide rail 19 and a second guide rail 20 extending in the X direction at a required interval as viewed in the Y direction, as shown in FIGS. 1 to 4 in the present embodiment. Further, a rack 21 extending in the X direction is arranged between the first guide rail 19 and the second guide rail 20, as shown in FIGS. 1 to 4 and FIG. 8, and each of the movement support platforms 10 and 10 is provided with a pinion 22 which can mesh with the rack 21.

The sewing machine bodies 11 according to the first sewing machine 7 and the second sewing machine 9 have the same structure. The sewing machine body 11 is provided with a base member 23 which is provided on the movement support platform 10, for example, having a rectangular plate shape long in the Y direction, and can reciprocate in the Y direction, a bed part 25 which is provided on the base member 23, a leg part 26 which is erected at an outer position on the bed part 25 as viewed in the Y direction, and an arm part 27 which is protruded in a horizontal state at an upper portion of the leg part 26, as shown in FIGS. 3 to 4 and FIGS. 8 to 10. The base member 23 is formed into a rectangular plate shape long in the Y direction, for example, as shown in FIG. 10, and the bed part 25 is provided with a shuttle for feeding a bobbin thread. Further, a head part 29 of the arm part 27 is provided with a needle bar drive mechanism which moves a sewing machine needle 30 up and down, and the needle bar drive mechanism sews the base part 17 (FIG. 6) of the attachment piece 16 to the edge portion 15 in cooperation with the shuttle.

Further, as shown in FIGS. 3 to 4 and FIGS. 8 to 9, sliding members 32 and 32 are provided at both side positions of a lower surface part 31 of the movement support platform 10 as viewed in the Y direction, the sliding members 32 and 32 being adapted to reciprocate in the X direction by being guided along the first guide rail 19 and the second guide rail 20. Further, as shown in FIG. 1 and FIGS. 8 to 9, a numerically controlled motor 36 such as a servo motor or a stepping motor is provided in a protrusion piece 35 protruded at a middle position of one side portion 33 (FIGS. 8 to 9) of the movement support platform 10 as viewed in the Y direction, and the pinion 22 capable of meshing with the rack 21 is firmly fixed to a motor output shaft 37 (FIG. 3) protruding downward through a through hole provided at the middle position of the protrusion piece 36. Accordingly, when the pinion 22 rotates forward and reverse in connection with forward and reverse rotation of the numerically controlled motor 36, the movement support platform 10 is guided along the first guide rail 19 and the second guide rail 20 and can move in the X direction, and an amount of movement can be desirably controlled by the program. In FIG. 8, the movement support platform 10 is shown by a single-dot chain line for convenience of description.

Further, as shown in FIGS. 3 to 4 and FIGS. 9 to 10, a first rail 40 and a second rail 41 extending in the Y direction are provided at both side positions of an upper surface part 39 of the movement support platform 10 as viewed in the X direction, and sliding members 43 and 43 are provided at both side positions of a lower surface part 42 of the base member 23 as viewed in the X direction, the sliding members 43 and 43 being adapted to be capable of reciprocating in the Y direction by being guided along the first rail 40 and the second rail 41.

Further, as shown in FIGS. 1 to 4 and FIG. 10, a moving device 46 reciprocating the base member 23 in the Y direction is provided between the first rail 40 and the second rail 41. For convenience of description, a side where the sewing platform portion 5 exists as viewed in the Y direction is referred to as "front side" or "front", and a direction toward the side where the sewing platform portion 5 exists is referred to as "forward direction". Further, the opposite side is referred to as "rear side" or "rear", and a direction toward the opposite side is referred to as "rearward direction".

Figure 3:
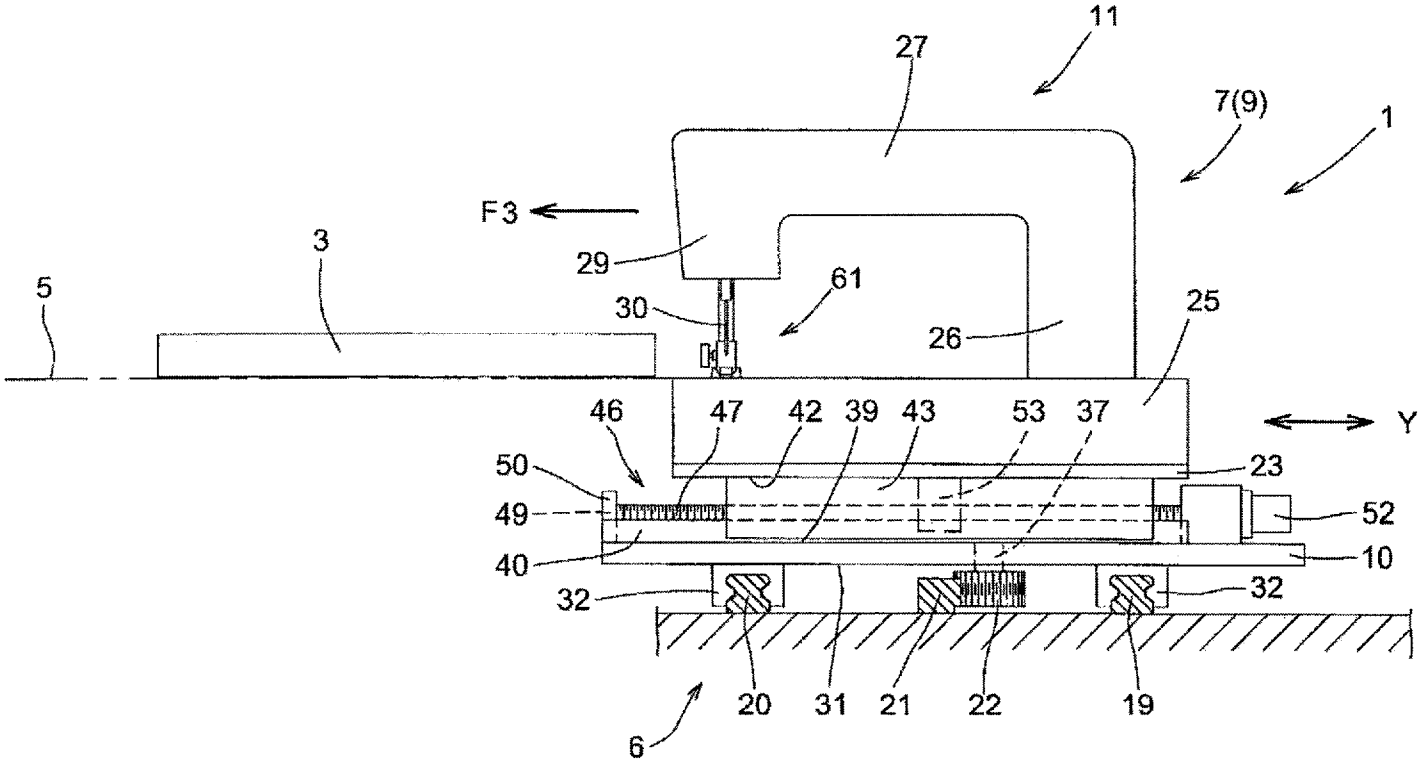
FIG. 3 is a side elevational view showing the sewing device according to the present invention in a state in which the sewing operation is stopped.
Figure 4:
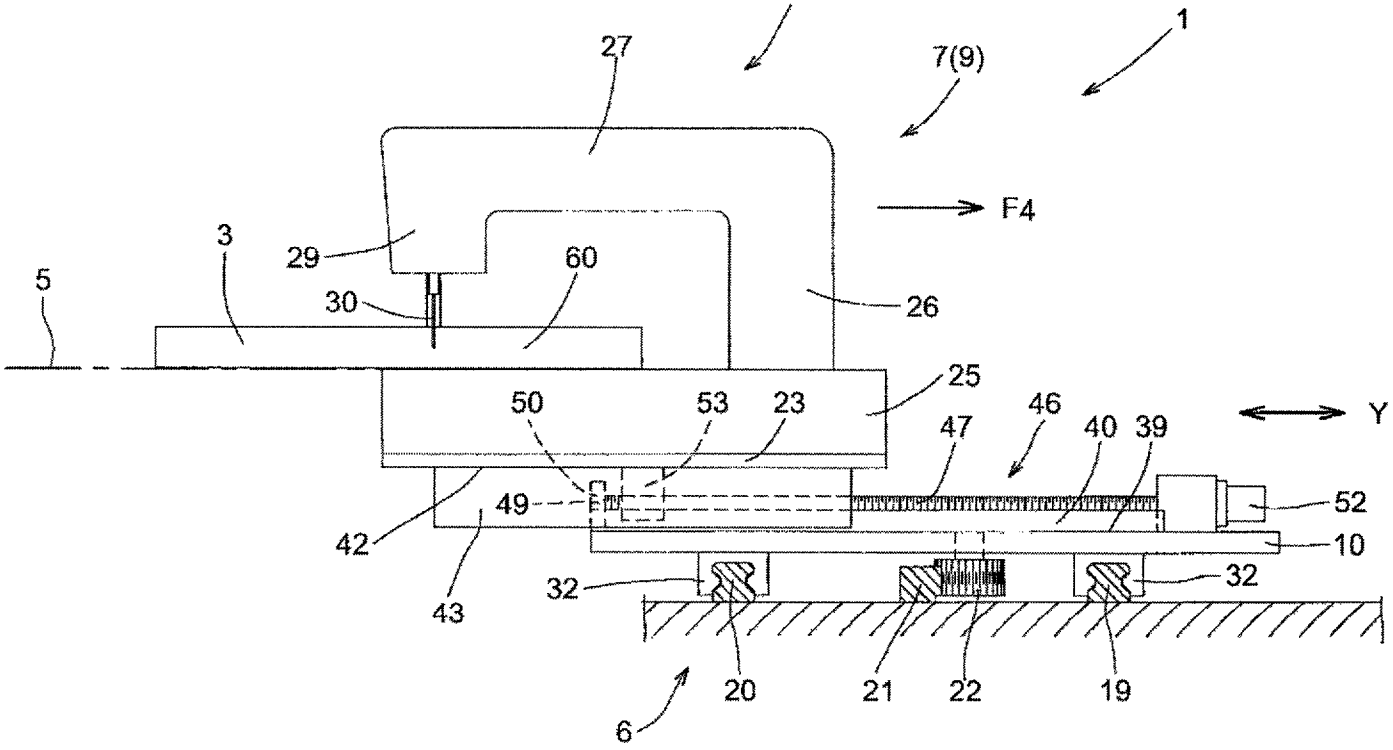
FIG. 4 is a side elevational view showing the sewing device according to the present invention in a state in which the sewing operation is performed.

The moving device 46 is arranged between the first rail 40 and the second rail 41 in such a manner that a drive screw shaft 47, for example, constructed by a ball screw extends in the Y direction, as shown in FIGS. 3 to 4 and FIG. 10. A front end portion 49 of the drive screw shaft 47 is supported by a bearing 50 and a motor output shaft of the numerically controlled motor 52 such as the servo motor or the stepping motor is coupled to an outer end part of the drive screw shaft 47. Further, a nut member 53 is fixed to an approximately middle position of the lower surface part 42 of the base member 23 as shown in FIGS. 3 to 4 and FIGS. 9 to 10, the nut member 53 being capable of threadably engaging with the drive screw shaft 47. In FIG. 10, for convenience of description, the base member 23 is illustrated by a single-dot chain line.

Thus, the drive screw shaft 47 is forward rotated by the numerically controlled motor 52, so that the base member 23 can move forward as shown in FIG. 2 and shown by an arrow F3 in FIG. 3. As a result, the sewing machine body 11 can move forward, for example, can move for about 300 mm. Further, since the drive screw shaft 47 is reverse rotated, the base member 23 in a forward moving state can move rearward as shown by an arrow F4 in FIG. 4. As a result, the sewing machine body 11 can move rearward.

As mentioned above, the first sewing machine 7 and the second sewing machine 9 can reciprocate along the straight guide rail 6 in the X direction as long as they do not collide with each other. In the present embodiment, as shown in FIGS. 1 to 2, the first sewing machine 7 is adapted to mainly perform the sewing operation in a left portion (one side portion as viewed in the extension direction) 15A of the edge portion 15 in the airbag body 13 (the object to be sewn 2), and the second sewing machine 9 is adapted to mainly perform the sewing operation in a right portion (the other side portion as viewed in the extension direction) of the edge portion 15. Since the first sewing machine 7 and the second sewing machine 9 reciprocate along the same straight guide rail 6 in the X direction as mentioned above, the safety device for collision avoidance is provided as mentioned above for preventing both the machines from colliding with each other when performing the sewing operation. In the present embodiment, the safety device is structured such as to desirably program control the numerically controlled motor 36, for example, such that the safety device can stop the pinion 22 on the basis of receiving a detection signal of a detection device.

Figure 5:
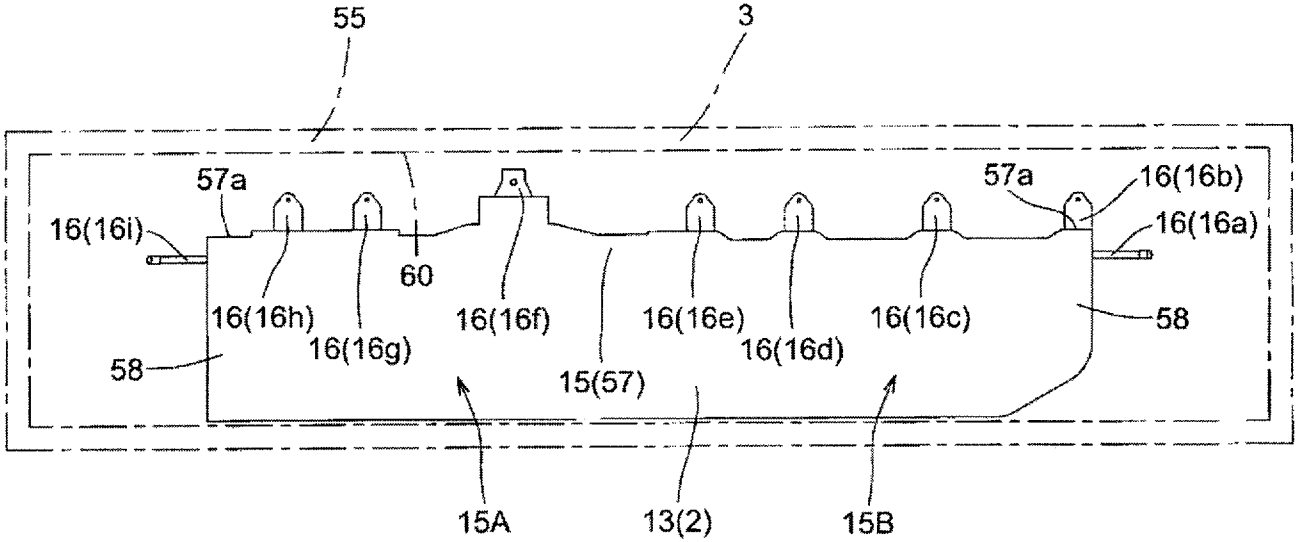
FIG. 5 is a plan view showing an airbag body corresponding to an object to be sewn in a state in which the airbag body is held to a pallet.

The pallet 3 installed in the sewing platform portion 5 is constructed by a rectangular frame body 55 which is elongated in the X direction, as shown in FIGS. 1 to 2. Further, the airbag body 13 (the object to be sewn 2) constructing the curtain airbag is desirably arranged in an inner space part 56 of the rectangular frame body 55. In FIGS. 1 to 2 and FIG. 5, in a right portion 15B of an upper edge portion 57 of the airbag body 13 as viewed in a suspended state, each of four attachment pieces 16, 16, 16 and 16 arranged at intervals is temporarily attached, for example, in such a manner as to protrude outward in a planar view in a state in which a base part 17 of the attachment piece is tucked in the upper edge portion 57.

Figure 6:
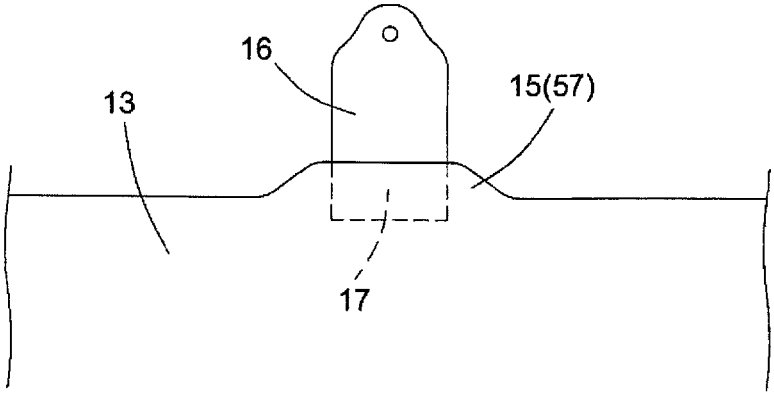
FIG. 6 is a plan view describing a sewing step of attaching an attachment piece to an edge portion of the airbag body by sewing.

Further, as shown in FIGS. 1 to 2 and FIG. 5, in a left portion 15A of the upper edge portion 57, each of three attachment pieces 16, 16 and 16 arranged at intervals is temporarily attached in such a manner as to protrude outward in a planar view in a state in which a base part 17 of the attachment piece is tucked in the upper edge portion 57, in the same manner as shown in FIG. 6.

Figure 7:
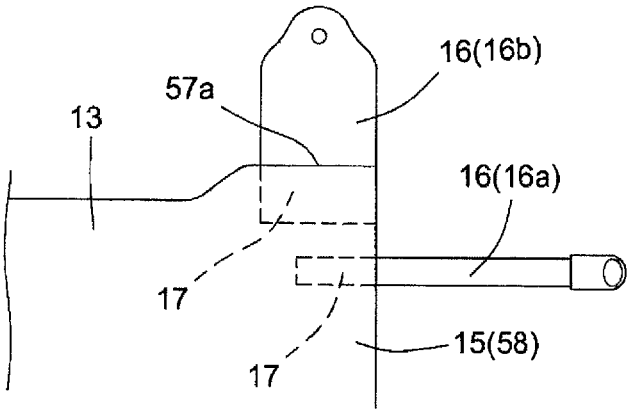

Further, as shown in FIGS. 5 and 7, at positions of right and left edge portions 58, 58 of the airbag body 13 near the edge portions 57, one attachment piece 16 is temporarily attached in such a manner as to protrude sideward in a planar view in a state in which a base part 17 of the attachment piece is tucked in the edge portion 58. Attachment position of the attachment piece 16 protruding sideward is away from an end edge 57*a* of the upper edge portion 57, for example, at about 200 mm.

The airbag body 13 to which the attachment piece 16 is temporarily attached as mentioned above is held via a clamp device (not shown) which is appropriately attached to an inner peripheral edge part of the rectangular frame body 55. Since it is necessary to fix the base part 17 (FIGS. 6 to 7) of the attachment piece 16 to the edge portion 15 of the airbag body 13 by sewing, a portion where the base part 17 exists is not clamped when holding as mentioned above.

The pallet 3 in which the airbag body 13 is held as mentioned above is installed to the sewing platform portion 5 in a fixed state, and the first and second sewing machines 7 and 9 perform the sewing operation of the edge portion 15.

FIGS. 1 and 3 show a state in which the first sewing machine 7 and the second sewing machine 9 stop sewing. The first and second sewing machines 7 and 9 both exists in the movement support platform 10 as a whole. Further, FIGS. 2 and 4 show a state in which the sewing machine body 11 forward moves at a required amount for sewing the base part 17 to the edge portion 15. In a state in which the sewing machine body 11 forward moves, a rear portion 60 of the pallet 3 installed to the sewing platform 5 in the fixed state can present a state in which the rear portion 60 is inserted between the arm part 27 and the bed part 25, as shown in FIG. 4. The sewing operation is performed in the fixed state of the pallet 3 with respect to the sewing platform portion 5, and is performed by required movement of the first and second sewing machines 7 and 9 in the XY direction according to the program control.

The sewing device 1 according to the present invention is program controlled, as mentioned above, such that the first sewing machine 7 and the second sewing machine 9 can reciprocate along the straight guide rail 6 in the X direction as long as they do not collide with each other, and any one of them can move from one side of the straight guide rail 6 toward the other side beyond the middle section thereof during the sewing operation of the first and second sewing machines 7 and 9. Further, the safety device for collision avoidance is provided so as to prevent the first sewing machine 7 and the second sewing machine 9 from colliding with each other.

Next, a description will be given of an example of a case where any one of the first and second sewing machines 7 and 9 moves toward the other of the straight guide rail 6 beyond the middle section of the straight guide rail 6 for sewing during the sewing operation of the first and second sewing machines 7 and 9. In FIGS. 1 to 2, it is assumed that the first sewing machine 7 mainly takes charge of the sewing operation of the left portion 15A of the edge portion 15 in the object to be sewn 2, and the second sewing machine 9 mainly takes charge of the sewing operation of the right portion 15B of the object to be sewn 2. In this case, a sewing amount in a sewing position may be increased in the left portion 15A or in the right portion 15B according to the object to be sewn. When this happens, for example, in a case where the sewing amount is increased in the right portion 15B, the first sewing machine 7 moves to the right portion 15B beyond the middle section and the first sewing machine 7 can assist the sewing operation of the second sewing machine 9.

Conversely, in a case where the sewing amount in the left portion 15A is large, the second sewing machine 9 moves to the left portion 15A beyond the middle section, and the second sewing machine 9 can assist the sewing operation of the first sewing machine 7. As a result, it is possible to allocate a sewing time corresponding to an amount to be sewn, that is, a time required for sewing the object to be sewn as a whole to the first and second sewing machines 7 and 9, and the sewing times of the first and second sewing machines 7 and 9 can be set to approximately the same level. Thus, an operation rate of the sewing device can be increased by reducing a stop time of the individual sewing machines. Therefore, it is possible to achieve an increase in productivity and a reduction in production cost for sewing.

In connection with the sewing operation, it is necessary to sequentially feed the pallet 3 holding the object to be sewn 2 to the sewing part 61 (FIG. 3) of the first sewing machine 7 and the second sewing machine 9. The movement of the pallet 3 may be performed manually, however, in the present embodiment, in order to achieve the increase in productivity by labor saving, the moving work is adapted to be performed by using a vertically circulating movement type pallet moving device 63 (FIGS. 1 and 11) which moves the pallet 3 in the vertically circulating movement path 62 (FIG. 11).

The vertically circulating movement type pallet moving device 63 is adapted to move four pallets 3, 3, 3 and 3 so as to draw a rectangle in a side view, as shown in FIG. 11. As a matter of convenience, it is assumed that four pallet are constituted by a first pallet 3*a*, a second pallet 3*b*, a third pallet 3*c* and a fourth pallet 3*d* as viewed counterclockwise in FIG. 11. While the first and second sewing machines 7 and 9 perform the required sewing operations for the airbag body 13 (the object to be sewn 2) held by the first pallet 3*a*, the worker detaches the sewing finished product held by the second pallet 3*b* which is arranged in a front side of the first pallet 3*a*, and holds a new object to be sewn 2. When the sewing operation of the object to be sewn 2 held by the first pallet 3*a* is finished, the vertically circulating movement type pallet changing device 63 laterally moves the first pallet 3*a* forward away from the first and second sewing machines 7 and 9. Along with this, the second pallet 3*b* in which the new object to be sewn 2 is held is moved down. At the same time, the third pallet 3*c* in which the object to be sewn 2 is held is laterally moved rearward where the first and second sewing machines 7 and 9 exist, and the fourth pallet 3*d* in which the object to be sewn 2 is held is moved up. The moved-up fourth pallet 3*d* is set to a state in which the fourth pallet is installed in a fixed state to the sewing platform portion 5. The first and second sewing machines 7 and 9 perform the required sewing operation for the object to be sewn 2 held by the fourth pallet 3*d* in the same manner as mentioned above. This cycle is repeated and the object to be sewn 2 is sequentially sewn.

Next, a description will be specifically given of the sewing operation by the first sewing machine 7 and the second sewing machine 9. In the sewing operation, in order to most shorten the sewing time of the object to be sewn 2, the sewing motions of the first and second sewing machines 7 and 9 are program controlled. The attachment pieces 16 in the right portion 15B in FIG. 5 are assumed to be a first attachment piece 16*a*, a second attachment piece 16*b*, a third attachment piece 16*c*, a fourth attachment piece 16*d* and fifth attachment piece 16*e* from the rightmost one to the left. Further, the attachment pieces 16 in the left portion 15A are assumed to be a sixth attachment piece 16*f*, a seventh attachment piece 16*g*, an eighth attachment piece 16*h* and a ninth attachment piece 16*i* from the center side.

On the basis of the program control, the second sewing machine 9 sews the base part 17 (FIGS. 6 to 7) of the first attachment piece 16*a* to the edge portion 15 according to a required sewing pattern, thereafter sews the base part 17 of the second attachment piece 16*b* to the edge portion 15 according to a required sewing pattern, and then sews the respective base parts 17 of the third to fifth attachment pieces 16*c*, 16*d* and 16*e* to the edge portion 15 sequentially according to required sewing patterns. The first sewing machine 7 sews the respective base parts 17 (FIGS. 6 to 7) of the sixth to ninth attachment pieces 16*f*, 16*g*, 16*h* and 16*i* to the edge portion 15 sequentially according to required sewing patterns on the basis of the program approximately at the same time of starting of the sewing operation in the present embodiment. In the present embodiment, it is programed such that the required sewing operations of the attachment pieces 16 to the base part 17 are approximately simultaneously finished by the first and second sewing machines 7 and 9.

As mentioned above, the second sewing machine 9 performs the sewing operation by the right portion 15B (FIG. 1) of the edge portion 15, and the first sewing machine 7 performs the sewing operation by the left portion 15A (FIG. 1) of the edge portion 15. Further, the sewing operations by both the first and second sewing machines 7 and 9 are approximately simultaneously performed even if there is a slight time lag before the sewing operation begins or there is several sewing operation stop time in the process of the sewing operation. Such being the case, in comparison with the pallet moving type sewing device m1 (FIG. 24) in which the pallet q is laterally movable to one sewing machine p fixed at the fixed position, the productivity can be improved about twice. Further, according to the pallet moving type sewing device m1, the installation space which is about twice the length of the airbag body a is required. However, in the sewing device 1 according to the present embodiment, a space saving can be achieved in comparison with the sewing device m1. As a result, it is possible to achieve cost reduction per unit area of the in-plant space, that is, reduction of the equipment cost. In combination with this, reduction of production cost of the sewn product can be expected, since the increase in productivity can be expected.

Further, according to the sewing device m2 (FIG. 25) in which two sewing machines r1 and r2 are fixed at the fixed positions, the installation space which is about four times the length of the airbag body a. However, in the sewing device 1 according to the present embodiment, the space saving can be achieved in comparison with the sewing device m2. As a result, it is possible to achieve the cost reduction per unit area of the in-plant space, that is, the reduction of the equipment cost, and the reduction of production cost of the sewn product can be expected.

Embodiment 2

FIG. 12A shows the other embodiment of the sewing device 1 according to the present invention. In the sewing device 1 according to the present embodiment, the first and second sewing machines 7 and 9 move along the straight guide rail 6 in the X direction for sewing. A left end 65 of a sewing travel range 64 of the straight guide rail 6 is provided with a first evacuation rail part 66 extending outward in an extension direction of the straight guide rail 6. Further, a right end 67 of the sewing travel range 64 is provided with a second evacuation rail part 69 extending outward in the extension direction of the straight guide rail 6. Further, when the first sewing machine 7 is troubled during the sewing operation of the first and second sewing machines 7 and 9, the first sewing machine 7 can move to the first evacuation rail part 66 to evacuate, as shown in FIG. 13. When the second sewing machine 9 is troubled, the second sewing machine 9 can move to the second evacuation rail part 69 to evacuate as shown in FIG. 14. Further, the other sewing machine which is not troubled performs the sewing operation in a whole of the sewing travel range 64.

Further, in the embodiment mentioned above, the moving work of the pallet 3 is performed by using the vertically circulating movement type pallet moving device 63 which circulates and moves the pallet 3 in the vertically circulating movement path 62 (FIG. 11). However, in the present embodiment, the pallet 3 is moved alternatively by using a horizontally circulating movement type pallet moving device 71 (FIG. 12A) which moves the pallet 3 in a horizontally circulating movement path 70.

The horizontally circulating movement type pallet moving device 71 moves the pallet 3 in the horizontally circulating movement path 70 in a required order in the present embodiment in such a manner as to draw a rectangle in a planar view clockwise in FIG. 12B.

The horizontally circulating movement path 70 is provided with a front side part 72 extending in a lateral direction and a rear side part 73 extending in a lateral direction in parallel at required intervals in a front-back direction as shown in FIG. 12B. A left portion 72A of the front side part 72 is set to a first work station 75, a right portion 72B thereof is set to a second work station 76, a right portion 73A of the rear side part 73 is set to a third work station 77, and a left portion 73B thereof is set to a fourth work station 79. Further, the pallet 3 is adapted to temporarily stop in the first work station 75, the second work station 76, the third work station 77 and the fourth work station 79, and the sewing operation by the first and second sewing machines 7 and 9 is performed to the object to be sewn 2 which the pallet 3 (3A) in the first work station 75 holds.

The object to be sewn 2 is adapted to be held to the pallet 3 (3C) in the third work station 77 and the pallet 3 (3D) in the fourth work station 79 during the sewing operation. Further, when the sewing operation to the object to be sewn 2 held in the pallet 3A is finished, the pallet 3A is moved to the second work station 76, the sewing finished product is removed from the pallet 3 (3B) in the second work station 76, and the pallet 3 thereafter moves to the third work station 77 to be in a temporary stop state, and thereafter moves to the fourth work station 79 to be in a temporary stop state.

Further, in the third work station 77 and the fourth work station 79, a work for holding a new object to be sewn 2 to the pallets 3C and 3D is manually performed, the pallet 3D to which the object to be sewn 2 is held moves to the first work station 75, and the sewing operation is applied to the object to be sewn 2 as mentioned above.

The movement of the pallet 3 can be performed, for example, by using a conveyor device including a circling belt which can move up and down and has an upper surface part circling toward one direction. The pallet 3 can be supported by the upper surface portion of the circling belt on the basis of the upward movement of the conveyor device, and the pallet 3 can be moved toward a required forward moving direction by desirably circling the circling belt in this state.

The other structures of the sewing device 1 according to the present embodiment are the same as those described in connection with the embodiment 1, and a specific description thereof will be therefore omitted.

The sewing device 1 according to the present embodiment employs the structure in which the first evacuation rail part 66 is provided in the left end of the sewing travel range 64 of the straight guide rail 6, and the second evacuation rail part 69 is provided in the right end of the sewing travel range 64, as mentioned above. Thus, when the first sewing machine 7 is troubled, the first sewing machine 7 can be moved to the first evacuation rail part 66 to be evacuated as shown in FIG. 13, and when the second sewing machine 9 is troubled, the second sewing machine 9 can be moved to the second evacuation rail part 69 to be evacuated as shown in FIG. 14. Further, the sewing operation can be continued in a whole of the sewing travel range 64 by the other sewing machine which is not troubled.

Therefore, according to the sewing device 1 having the structure mentioned above, there is an advantage that in a case where any one of the first and second sewing machines 7 and 9 is troubled, an entire sewing operation can be continued by the other sewing machine which is not troubled, without stopping the entire sewing operation of the sewing device.

Further, in a case where the present invention is further structured such that the first and second sewing machines 7 and 9 can both move to any one of the first and second evacuation rail parts 66 and 69 (for example, the first evacuation rail part 66), it is possible to collectively check the troubles in the first and second sewing machines 7 and 9 and dissolve the troubles for two sewing machines by moving both the first and second sewing machines 7 and 9 to the evacuation rail part 66, as shown in FIG. 15. For example, it is possible to inspect and clean the first and second sewing machines 7 and 9 when starting the first and second sewing machines 7 and 9 and adjust the sewing motion of the sewing machines in the evacuation rail part 66. Further, it is possible to replace the consumable parts such as the needle and repair the broken sewing machine in the evacuation rail part 66.

Further, in a case where the sewing device 1 according to the present embodiment is provided with the horizontally circulating movement type pallet moving device 71 (FIG. 12A), it is possible to perform a work for detaching the sewing finished product in the second work station 76 and a work for holding the object to be sewn 2 to the pallet 3 in the third work station 77 and the fourth work station 79 in a plenty of time during the sewing time by the first and second sewing machines 7 and 9. As mentioned above, when employing the sewing device 1 according to the present embodiment, there is an advantage that the working place by the worker can be expanded from one place to three places in comparison with the case of employing the sewing device 1 using the vertically circulating movement type pallet moving device 63.

A description will be given as follows of the advantage by comparing with the vertically circulating movement type pallet moving device 63, for example, shown in FIG. 11. More specifically, in the case of employing the vertically circulating movement type pallet moving device 63, the work for holding the object to be sewn 2 to the pallet 3 can not be performed during the sewing time of the first and second sewing machines 7 and 9. Thus, there may occur a disadvantage that it is unavoidable to wastefully stop the sewing motions of the first and second sewing machines 7 and 9. On the contrary, when employing the sewing device 1 according to the present embodiment, the working place is expanded as mentioned above, so that the sewing motions of the first and second sewing machines 7 and 9 can be continuously performed. Therefore, it is possible to more effectively achieve the advantage of the increase in productivity achieved by the first and second sewing machines.

Embodiment 3

FIGS. 16 to 19 show the other aspect of the sewing device 1 according to the present invention. The straight guide rail 6 extending in the X direction is constructed by a first straight guide rail 80 and a second straight guide rail 81 which are constructed separately. It is assumed that the first straight guide rail 80 reciprocating the movement support platform 10 of the first sewing machine 7 in the X direction is constructed by a first guide rail 82 and a second guide rail 83 which are arranged forth and back, and the second straight guide rail 81 reciprocating the movement support platform 10 of the second sewing machine 9 in the X direction is constructed by a first guide rail 85 and a second guide rail 86 which are arranged forth and back. Further, in FIGS. 16 to 18, the movement support platform 10, the sewing machine body 11 and the first straight guide rail 80 associated with the first sewing machine 7 are illustrated by a thick solid line for convenience of description, and the second guide rail 86 mentioned later constructing the movement support platform 10, the sewing machine body 11 and the second straight guide rail 81 associated with the second sewing machine 9 is illustrated by a narrow solid line for convenience of description. Then, a description will be given of these elements below.

In the sewing device 1 according to FIG. 16, the first guide rail 85 associated with the second sewing machine 9 is arranged in a rear side of the first guide rail 82 associated with the first sewing machine 7, and the second guide rail 86 associated with the second sewing machine 9 is arranged in a rear side of the second guide rail 83 associated with the first sewing machine 7. In this case, both the sewing machine bodies 11 and 11 can forward move toward the object to be sewn 2 which is held to the pallet 3, as shown by an arrow in FIG. 16.

In the sewing device 1 according to FIG. 17, the first and second guide rails 85 and 86 associated with the second sewing machine 9 are arranged between the first and second guide rails 82 and 83 associated with the first sewing machine 7. In this case, both the sewing machine bodies 11 and 11 can forward move toward the object to be sewn which is held to the pallet 3, as shown by an arrow in FIG. 17.

The sewing device 1 according to FIG. 18 shows an example in a case where one of the first and second guide rails associated with the first sewing machine 7 is in common with one of the first and second guide rails associated with the second sewing machine 9. More specifically, the first guide rail 82 associated with the first sewing machine 7 and the first guide rail 85 associated with the second sewing machine 9 are formed as a common rail, and the second guide rail 86 associated with the second sewing machine 9 is arranged in a rear side of the second guide rail 83 associated with the first sewing machine 7. A case where the first guide rails 82 and 85 are structured in common as mentioned above is included in the case where the first straight guide rail 80 and the second straight guide rail 81 are separated.

In the sewing device 1 according to FIG. 19, the first straight guide rail 80 associated with the first sewing machine 7 and the second straight guide 81 associated with the second sewing machine 9 are arranged separately in parallel in both sides of the sewing platform portion 5, and the first straight guide rail 80 is constructed by a first guide rail 82 and a second guide rail 83 which extend in the X direction. Further, the second straight guide rail 81 is constructed by a first guide rail 85 and a second guide rail 86 which extend in the X direction. In this case, the sewing machine bodies 11 and 11 can forward move toward the object to be sewn 2 which is held to the pallet 3, as shown by an arrow in FIG. 19. A safety device for collision avoidance is provided so as to prevent the first and second sewing machines 7 and 9 from colliding with each other when both the sewing machines 7 and 9 reciprocate along the first and second straight guide rails 80 and 81 in the X direction.

The sewing device 1 according to FIGS. 16 to 19 is also program controlled in the same manner as that in the embodiments 1 and 2 in such a manner that any one of the first and second sewing machines 7 and 9 can move from one of the first straight guide rail 80 and the second straight guide rail 81 toward the other side thereof beyond the middle section thereof during the sewing operation of the first and second sewing machines 7 and 9, and the sewing operation by the first and second sewing machines 7 and 9 is performed by the required movement of the first and second sewing machines 7 and 9 in the X and Y directions according to the program control. Further, these sewing devices 1 can be provided with the first and second evacuation rail parts 66 and 69 which are desirably structured and desirably operate, in the same manner as specifically described in the embodiment 2. The vertically circulating movement type pallet moving device 63 can be additionally provided in the same manner as shown in FIG. 11, and the horizontally circulating movement type pallet moving device 71 can be additionally provided in the same manner as shown in FIG. 12A.

Embodiment 4

It goes without saying that the present invention is not limited to the structures shown by the embodiments, but can be variously design changed within the scope of "Claims". Such design change will be exemplified as follows.

(1) In the first sewing machine 7 and the second sewing machine 9 which are positioned in left and right sides of the straight guide rail 6 (constructed by the first guide rail 19 and the second guide rail 20 in FIGS. 1 to 2) as viewed in the X direction, a plurality of first sewing machines and second sewing machines may be respectively arranged side by side in the X direction. In the case of employing the structure mentioned above, the sewing operation can be more efficiently performed by the plurality of sewing machines, for example, even in a case where the object to be sewn 2 extending in the X direction is long and the number of position to be sewn is large.

In some object to be sewn, the sewing amount of the position to be sewn may be more in the left portion 15A or more in the right portion 15B. Therefore, the numbers of the first and second sewing machines 7 and 9 may be differentiated, for example, the number of only one of the first sewing machine 7 and the second sewing machine 9 is set to plural number and the number of the other thereof is set to one. Further, in the first sewing machine 7 and the second sewing machine 9, the length of the arm part 27 (FIGS. 3 to 4) may be set to be short in a case where the sewing operation of the object to be sewn by the sewing machines is dedicated only in a portion in an edge side of the pallet.

(2) FIGS. 20 to 21 show the other aspect of the movement support platform 10, and the movement support platform 10 is formed into a gate shape. The movement support platform 10 is more specifically constructed by an upper transverse member 90 which cuts across the pallet in a front-back direction above the pallet 3, and a lower transverse member 91 which is arranged below the upper transverse member 90, is substantially integrated with the upper transverse member 90 and cuts across the pallet 3 in the front-back direction. Further, the upper transverse member 90 is provided with an upper accommodation part 92 which constructs the sewing machine body 11 capable of reciprocating in the Y direction and in which a needle bar drive mechanism moving the sewing machine needle 30 up and down is accommodated, and the lower transverse member 91 is provided with a lower accommodation part 93 which constructs the sewing machine body 11 and in which a shuttle feeding a bobbin thread is accommodated. Further, the upper and lower accommodation parts 92 and 93 synchronously move in the X and Y directions according to the program control.

Further, leg column parts 95 and 95 are protruded downward in both end sides 94 and 94 of the upper transverse member 90, and the movement support platform 10 is formed into the gate shape as mentioned above. In the present embodiment, both ends 96 and 96 of the lower transverse member 91 are coupled directly, for example, to inner surface parts of the leg column parts 95 and 95, so that the lower transverse member 91 is substantially integrated with the upper transverse member 90.

An aspect that the lower transverse member 91 is substantially integrated with the upper transverse member 90 includes an aspect that the lower transverse member 91 is structured such as to be capable of reciprocating in the X direction in synchronous with the upper transverse member even if both ends 96 and 96 of the lower transverse member 91 are not directly coupled to the leg column parts 95 and 95.

The gate-shaped movement support platform 10 having the structure mentioned above can reciprocate in the X direction by the lower end portions of both the leg column parts 96 and 96 being guided along the straight guide rail 6 provided along the front and rear edge parts 97 and 97 (FIG. 20) of the sewing platform portion 5. As a result, the sewing operation by the first sewing machine 7 and the second sewing machine 9 is performed by a required movement of the first and second sewing machines 7 and 9 in the X and Y directions according to the program control. Here, "provided along the edge parts 97 and 97" mentioned above includes a case where being provided along the edge part in an outer side of the edge part 97, and a case where being provided along the edge part in an inner side of the edge part 97.

The upper accommodation part 92 is provided at a required position such as a lower surface part or a side surface part of the upper transverse member 90, for example, the side surface part 99, and can reciprocate in the Y direction. The lower accommodation part 93 is provided in the same manner as the lower transverse member 91 and can reciprocate in the Y direction. A means for reciprocating the upper and lower accommodation parts 92 and 93 in the Y direction can be constructed by the forward and reverse rotation of the drive screw shaft, and can be also constructed by using various known means such as a means constructed by using a rack and pinion, and a moving means using a timing belt.

In a case where the movement support platform 10 is structured such as to form the gate shape, an entire lower space of the upper transverse member 90 can be formed as a sewing area. Therefore, there is an advantage that a wide object to be sewn over an approximately whole of the lower space can be sewn with no trouble. Further, both end sides 94 and 94 of the upper transverse member 90 are supported by the straight guide rail 6 via the leg column parts 95 and 95 even in a case where the upper transverse member 90 is long. Thus, it is possible to stably support the needle bar drive mechanism during the sewing operation, and it is therefore possible to perform the sewing operation by the first and second sewing machines 7 and 9 in a stable state.

In a case where the movement support platform 10 is formed into the gate shape, the number of the first sewing machine 7 and the second sewing machine 9 can be set to one or plural number arranged side by side in the X direction. FIG. 20 shows a case in which the plurality of sewing machines are provided, and two gate-shaped movement support platforms 10 are provided respectively for constructing the first sewing machines 7 and the second sewing machines 9, for example.

(3) As long as the straight guide rail 6 can allow the first and second sewing machines 7 and 9 to stably travel in the X direction in a case where the first and second sewing machines 7 and 9 are adapted to be capable or reciprocating along the same straight guide rail 6 in the X direction, the first and second guide rails 19 and 20 are not limited in their numbers, and may be constructed by one rail.

Further, as long as the first and second straight guide rails 80 and 81 can allow the first and second sewing machines 7 and 9 to stably travel in the X direction in a case where the straight guide rail 6 is constructed by the separate first and second straight guide rails 80 and 81, the second straight guide rail 81 in FIG. 17, and the first and second straight guide rails 80 and 81 in FIG. 19 may be respectively constructed by one rail, for example.

(4) As long as the movement support platform 10 provided with the sewing machine body 11 can be stably traveled in the Y direction, the first rail 40 and the second rail 41 shown in FIGS. 9 to 10 may be structured such as to be used by one rail in common.

(5) In a case where the means for reciprocating the movement support platform 10 constructing the first and second sewing machines 7 and 9 in the X direction is constructed by the rack 21 and the pinion 22 mentioned above, a manufacturing cost of the sewing device 1 can be preferably reduced by simplification of the structure. In this case, the rack 21 may be provided in the first guide rail 19 or the second guide rail 20.

Further, the means for reciprocating the movement support platform 10 in the X direction can employ various known means such as a moving means using a ball screw and a moving means using a timing belt.

(6) The means for reciprocating the base member 23 in the Y direction can be constructed by using various known means such as a means constructed by using a rack and pinion and a means constructed by using a timing belt in addition, to the means using the drive screw shaft 47 formed by the ball screw.

(7) The motion for sewing of the first sewing machine 7 and the second sewing machine 9 is various, and the motion is performed by actuating the safety device for collision avoidance when necessary. Therefore, the sewing operation according to the present invention can be performed by program controlling so as to shorten the sewing time of the object to be sewn 2 as much as possible.

(8) The sewing device 1 according to the present invention is preferably used when manufacturing the curtain airbag mentioned above, and is preferably applied in a case where the object to be sewn is long and a lot of sewing steps are provided, such as a case where a required sewing operation is applied to an upper edge portion of a general curtain over an entire length, and a case where an embroidery is applied to the long object to be sewn.

(9) In the sewing device according to the present invention, the long object to be sewn 2 includes, for example, an object to be sewn which is formed long as a whole by arranging a lot of short object pieces to be sewn side by side on a straight line. In this case, it is possible to perform the sewing operation for a lot of short object pieces to be sewn at one time, thereby performing a multiple-piece sewing operation.

REFERENCE SIGNS LIST

1 sewing device
2 object to be sewn
3 pallet
5 sewing platform portion
6 straight guide rail
7 first sewing machine
9 second sewing machine
10 movement support platform
11 sewing machine body
13 airbag body
15 edge portion
16 attachment piece
17 base part
19 first guide rail
20 second guide rail
21 rack
22 pinion
66 first evacuation rail part
69 second evacuation rail part
71 horizontally circulating movement type pallet moving device
75 first work station
76 second work station
77 third work station
79 fourth work station
80 first straight guide rail
81 second straight guide rail
90 upper transverse member
91 lower transverse member
92 upper accommodation part
93 lower accommodation part
95 leg column part
97 edge part

The invention claimed is:

1. A sewing device comprising:

a straight guide rail extending in an X direction, the straight guide rail being disposed in a sewing platform portion for installing in a fixed state a pallet holding an object to be sewn;

one first sewing machine or a plurality of first sewing machines disposed in parallel;

one second sewing machine or a plurality of second sewing machines disposed in parallel;

the first sewing machine or the first sewing machines and the second sewing machine or the plurality of sewing machines being disposed at left and right sides of the straight guide rail as viewed in the X direction;

a movement support platform disposed in both of the first sewing machine and the second sewing machine, the movement support platform allowing the straight guide rail to reciprocate in the X direction; and a sewing machine body disposed in the movement support platform, the sewing machine body beings capable of reciprocating in a Y direction, wherein the first sewing machine and the second sewing machine are both capable of sewing in the same sewing area extending in the X direction, and wherein the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

2. The sewing device according to claim 1, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, and wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range.

3. The sewing device according to claim 1, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range, and wherein the first and second sewing machine are both movable to any one of the first evacuation rail part and the second evacuation rail part.

4. The sewing device according to claim 1, wherein the sewing device is provided with a horizontally circulating movement path for moving the pallet in a required order in such a manner as to draw a rectangular shape in a planar view, the horizontally circulating movement path is provided with a front side part extending in a lateral direction and a rear side part extending in the lateral direction at a required interval, wherein a left portion of the front side part is formed as a first work station, a right portion of the front side part is formed as a second work station, a right portion of the rear side part is formed as a third work station, a left portion of the rear side part is formed as a fourth work station, and the pallet is adapted to temporarily stop in the first work station, the second work station, the third work station and the fourth work station, and wherein a sewing operation is adapted to be performed by the first and second sewing machine to the object to be sewn which the pallet in the first work station holds, a new object to be sewn is adapted to be held to the pallet in the third work station and the fourth work station during the sewing operation, the pallet moves to the second work station to come to a temporary stop state when the sewing operation to the object to be sewn held in the pallet is finished in the first work station, a sewing finished product is removed from the pallet in the second work station, the pallet thereafter moves to the third work station to a temporary stop state, and thereafter moves to the fourth work station to a temporary stop state, the object to be sewn is held to the pallet in the third work station and the fourth work station, the pallet holding the object to be sewn moves to the first work station, and the sewing operation is applied to the object to be sewn as mentioned above.

5. The sewing device according to claim 1, wherein the movement support platform capable of reciprocating along the straight guide rail in the X direction is provided with an upper transverse member cutting across the pallet in a front-back direction above the pallet, and a lower transverse member arranged below the upper transverse member and cutting across the pallet in the front-back direction, and the lower transverse member is substantially integrated with the upper transverse member, wherein the upper transverse member is provided with an upper accommodation part in such a manner that the upper accommodation part is capable of reciprocating in the Y direction, the upper accommodation part constructing the sewing machine body and in which a needle bar drive mechanism moving a sewing machine needle up and down is accommodated, wherein the lower transverse member is provided with a lower accommodation part in such a manner that the lower accommodation part is capable of reciprocating in the Y direction, the lower accommodation part constructing the sewing machine body and in which a shuttle feeding a bobbin thread is accommodated, and the upper and lower accommodation parts are synchronously movable in the X and Y directions according to a program control, and wherein leg column parts are protruded downward in both end sides of the upper transverse member, and lower end portions of both the leg column parts are capable of reciprocating in the X direction by being guided along the straight guide rail provided along front and rear edge parts of the sewing platform portion and extending in the X direction.

6. A sewing device comprising:

a straight guide rail extending in an X direction, the straight guide rail being disposed in a sewing platform portion for installing in a fixed state a pallet holding an object to be sewn;

one first sewing machine or a plurality of first sewing machines disposed in parallel;

one second sewing machine or a plurality of second sewing machines disposed in parallel;

the first sewing machine or the first sewing machines and the second sewing machine or the plurality of sewing machines being disposed at left and right sides of the straight guide rail as viewed in the X direction;

a movement support platform disposed in both of the first sewing machine and the second sewing machine, the movement support platform allowing the straight guide rail to reciprocate in the X direction; and a sewing machine body disposed in the movement support platform, the sewing machine body beings capable of reciprocating in a Y direction, wherein the first sewing machine and the second sewing machine are both capable of sewing in the same sewing area extending in the X direction, the first sewing machine and the second sewing machine are both capable of forward moving toward an object to be sewn which is held by the pallet, and the forward moving directions of both the sewing machine are the same, and wherein the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

7. The sewing device according to claim 6, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, and wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range.

8. The sewing device according to claim 6, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range, and wherein the first and second sewing machine are both movable to any one of the first evacuation rail part and the second evacuation rail part.

9. The sewing device according to claim 6, wherein the sewing device is provided with a horizontally circulating movement path for moving the pallet in a required order in such a manner as to draw a rectangular shape in a planar view, the horizontally circulating movement path is provided with a front side part extending in a lateral direction and a rear side part extending in the lateral direction at a required interval, wherein a left portion of the front side part is formed as a first work station, a right portion of the front side part is formed as a second work station, a right portion of the rear side part is formed as a third work station, a left portion of the rear side part is formed as a fourth work station, and the pallet is adapted to temporarily stop in the first work station, the second work station, the third work station and the fourth work station, and wherein a sewing operation is adapted to be performed by the first and second sewing machine to the object to be sewn which the pallet in the first work station holds, a new object to be sewn is adapted to be held to the pallet in the third work station and the fourth work station during the sewing operation, the pallet moves to the second work station to come to a temporary stop state when the sewing operation to the object to be sewn held in the pallet is finished in the first work station, a sewing finished product is removed from the pallet in the second work station, the pallet thereafter moves to the third work station to a temporary stop state, and thereafter moves to the fourth work station to a temporary stop state, the object to be sewn is held to the pallet in the third work station and the fourth work station, the pallet holding the object to be sewn moves to the first work station, and the sewing operation is applied to the object to be sewn as mentioned above.

10. The sewing device according to claim 6, wherein the movement support platform capable of reciprocating along the straight guide rail in the X direction is provided with an upper transverse member cutting across the pallet in a front-back direction above the pallet, and a lower transverse member arranged below the upper transverse member and cutting across the pallet in the front-back direction, and the lower transverse member is substantially integrated with the upper transverse member, wherein the upper transverse member is provided with an upper accommodation part in such a manner that the upper accommodation part is capable of reciprocating in the Y direction, the upper accommodation part constructing the sewing machine body and in which a needle bar drive mechanism moving a sewing machine needle up and down is accommodated, wherein the lower transverse member is provided with a lower accommodation part in such a manner that the lower accommodation part is capable of reciprocating in the Y direction, the lower accommodation part constructing the sewing machine body and in which a shuttle feeding a bobbin thread is accommodated, and the upper and lower accommodation parts are synchronously movable in the X and Y directions according to a program control, and wherein leg column parts are protruded downward in both end sides of the upper transverse member, and lower end portions of both the leg column parts are capable of reciprocating in the X direction by being guided along the straight guide rail provided along front and rear edge parts of the sewing platform portion and extending in the X direction.

11. A sewing device comprising:

a straight guide rail extending in an X direction, the straight guide rail being disposed in a sewing platform portion for installing in a fixed state a pallet holding an object to be sewn;

one first sewing machine or a plurality of first sewing machines disposed in parallel;

one second sewing machine or a plurality of second sewing machines disposed in parallel;

the first sewing machine or the first sewing machines and the second sewing machine or the plurality of sewing machines being disposed at left and right sides of the same straight guide rail as viewed in the X direction;

a movement support platform disposed in both of the first sewing machine and the second sewing machine, the movement support platform allowing the straight guide rail to reciprocate in the X direction; and a sewing machine body disposed in the movement support platform, the sewing machine body beings capable of reciprocating in a Y direction, wherein the first sewing machine and the second sewing machine are both capable of sewing in the same sewing area extending in the X direction, the first sewing machine and the second sewing machine are both capable of forward moving toward an object to be sewn which is held by the pallet, and the forward moving directions of both the sewing machine are the same, and wherein the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

12. The sewing device according to claim 11, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, and wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range.

13. The sewing device according to claim 11, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range, and wherein the first and second sewing machine are both movable to any one of the first evacuation rail part and the second evacuation rail part.

14. The sewing device according to claim 11, wherein the sewing device is provided with a horizontally circulating movement path for moving the pallet in a required order in such a manner as to draw a rectangular shape in a planar view, the horizontally circulating movement path is provided with a front side part extending in a lateral direction and a rear side part extending in the lateral direction at a required interval, wherein a left portion of the front side part is formed as a first work station, a right portion of the front side part is formed as a second work station, a right portion of the rear side part is formed as a third work station, a left portion of the rear side part is formed as a fourth work station, and the pallet is adapted to temporarily stop in the first work station, the second work station, the third work station and the fourth work station, and wherein a sewing operation is adapted to be performed by the first and second sewing machine to the object to be sewn which the pallet in the first work station holds, a new object to be sewn is adapted to be held to the pallet in the third work station and the fourth work station during the sewing operation, the pallet moves to the second work station to come to a temporary stop state when the sewing operation to the object to be sewn held in the pallet is finished in the first work station, a sewing finished product is removed from the pallet in the second work station, the pallet thereafter moves to the third work station to a temporary stop state, and thereafter moves to the fourth work station to a temporary stop state, the object to be sewn is held to the pallet in the third work station and the fourth work station, the pallet holding the object to be sewn moves to the first work station, and the sewing operation is applied to the object to be sewn as mentioned above.

15. The sewing device according to claim 11, wherein the movement support platform capable of reciprocating along the straight guide rail in the X direction is provided with an upper transverse member cutting across the pallet in a front-back direction above the pallet, and a lower transverse member arranged below the upper transverse member and cutting across the pallet in the front-back direction, and the lower transverse member is substantially integrated with the upper transverse member, wherein the upper transverse member is provided with an upper accommodation part in such a manner that the upper accommodation part is capable of reciprocating in the Y direction, the upper accommodation part constructing the sewing machine body and in which a needle bar drive mechanism moving a sewing machine needle up and down is accommodated, wherein the lower transverse member is provided with a lower accommodation part in such a manner that the lower accommodation part is capable of reciprocating in the Y direction, the lower accommodation part constructing the sewing machine body and in which a shuttle feeding a bobbin thread is accommodated, and the upper and lower accommodation parts are synchronously movable in the X and Y directions according to a program control, and wherein leg column parts are protruded downward in both end sides of the upper transverse member, and lower end portions of both the leg column parts are capable of reciprocating in the X direction by being guided along the straight guide rail provided along front and rear edge parts of the sewing platform portion and extending in the X direction.

16. A sewing device comprising:

a straight guide rail extending in an X direction, the straight guide rail being disposed in a sewing platform portion for installing in a fixed state a pallet holding an object to be sewn;

one first sewing machine or a plurality of first sewing machines disposed in parallel;

one second sewing machine or a plurality of second sewing machines disposed in parallel;

the first sewing machine or the first sewing machines and the second sewing machine or the plurality of sewing machines being disposed at left and right sides of the straight guide rail as viewed in the X direction;

the straight guide rail being constituted by a first straight guide rail and a second straight guide rail which are separately provided;

the first straight guide rail including the first sewing machine;

the second straight guide rail including the second sewing machine;

a movement support platform disposed in both of the first sewing machine and the second sewing machine, the movement support platform allowing the straight guide rail to reciprocate in the X direction; and a sewing machine body disposed in the movement support platform, the sewing machine body beings capable of reciprocating in a Y direction, wherein the first sewing machine and the second sewing machine are both capable of sewing in the same sewing area extending in the X direction, wherein the first sewing machine and the second sewing machine allow the straight guide rail to reciprocate in the X direction as long as they do not collide with each other, and are program controlled in such a manner that any one of the first sewing machine and the second sewing machine is capable of moving from one side of the straight guide rail toward the other side beyond a middle section thereof during the sewing operation of the first and second sewing machines, a safety device for collision avoidance is provided so as to prevent the first sewing machine and the second sewing machine from colliding with each other, and a sewing operation by the first sewing machine and the second sewing machine is performed by required movement in the X and Y directions of the first and second sewing machines according to a program control.

17. The sewing device according to claim 16, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, and wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range.

18. The sewing device according to claim 16, wherein a first evacuation rail part extending outward in an extension direction of the straight guide rail is provided in a left end of a sewing travel range of the straight guide rail on which the first and second sewing machines move in the X direction for the sewing operation, and a second evacuation rail part extending outward in the extension direction of the straight guide rail is provided in a right end of the sewing travel range, wherein when the first sewing machine is troubled during the sewing operation of the first and second sewing machines, the first sewing machine is movable to the first evacuation rail part to be evacuated, when the second sewing machine is troubles, the second sewing machine is moved to the second evacuation rail part to be evacuated, and the other sewing machine having no trouble performs the sewing operation in a whole of the sewing travel range, and wherein the first and second sewing machine are both movable to any one of the first evacuation rail part and the second evacuation rail part.

19. The sewing device according to claim 16, wherein the sewing device is provided with a horizontally circulating movement path for moving the pallet in a required order in such a manner as to draw a rectangular shape in a planar view, the horizontally circulating movement path is provided with a front side part extending in a lateral direction and a rear side part extending in the lateral direction at a required interval, wherein a left portion of the front side part is formed as a first work station, a right portion of the front side part is formed as a second work station, a right portion of the rear side part is formed as a third work station, a left portion of the rear side part is formed as a fourth work station, and the pallet is adapted to temporarily stop in the first work station, the second work station, the third work station and the fourth work station, and wherein a sewing operation is adapted to be performed by the first and second sewing machine to the object to be sewn which the pallet in the first work station holds, a new object to be sewn is adapted to be held to the pallet in the third work station and the fourth work station during the sewing operation, the pallet moves to the second work station to come to a temporary stop state when the sewing operation to the object to be sewn held in the pallet is finished in the first work station, a sewing finished product is removed from the pallet in the second work station, the pallet thereafter moves to the third work station to a temporary stop state, and thereafter moves to the fourth work station to a temporary stop state, the object to be sewn is held to the pallet in the third work station and the fourth work station, the pallet holding the object to be sewn moves to the first work station, and the sewing operation is applied to the object to be sewn as mentioned above.

20. The sewing device according to claim 16, wherein the movement support platform capable of reciprocating along the straight guide rail in the X direction is provided with an upper transverse member cutting across the pallet in a front-back direction above the pallet, and a lower transverse member arranged below the upper transverse member and cutting across the pallet in the front-back direction, and the lower transverse member is substantially integrated with the upper transverse member, wherein the upper transverse member is provided with an upper accommodation part in such a manner that the upper accommodation part is capable of reciprocating in the Y direction, the upper accommodation part constructing the sewing machine body and in which a needle bar drive mechanism moving a sewing machine needle up and down is accommodated, wherein the lower transverse member is provided with a lower accommodation part in such a manner that the lower accommodation part is capable of reciprocating in the Y direction, the lower accommodation part constructing the sewing machine body and in which a shuttle feeding a bobbin thread is accommodated, and the upper and lower accommodation parts are synchronously movable in the X and Y directions according to a program control, and wherein leg column parts are protruded downward in both end sides of the upper transverse member, and lower end portions of both the leg column parts are capable of reciprocating in the X direction by being guided along the straight guide rail provided along front and rear edge parts of the sewing platform portion and extending in the X direction.

* * * * *